US006354766B1

(12) United States Patent
Fox

(10) Patent No.: US 6,354,766 B1
(45) Date of Patent: Mar. 12, 2002

(54) METHODS FOR FORMING A SHORT AGGREGATE PIER AND A PRODUCT FORMED FROM SAID METHODS

(75) Inventor: Nathaniel S. Fox, Scottsdale, AZ (US)

(73) Assignee: Geotechnical Reinforcement Company, Inc., Scottsdale, AZ (US)

( * ) Notice: Subject to any disclaimer, the term of this patent is extended or adjusted under 35 U.S.C. 154(b) by 0 days.

(21) Appl. No.: 09/247,725

(22) Filed: Feb. 9, 1999

(51) Int. Cl.[7] ..... E02D 3/08

(52) U.S. Cl. ..... 405/232; 405/237; 405/238; 405/239; 405/240; 73/784; 73/11.03

(58) Field of Search ..... 405/229, 231–233, 405/237–240, 243, 258, 263, 271; 73/84, 784, 786, 11.03; 175/57

(56) References Cited

U.S. PATENT DOCUMENTS

| | | | | | |
|---|---|---|---|---|---|
| 3,638,433 | A | * | 2/1972 | Sherard | 405/50 |
| 3,685,302 | A | * | 8/1972 | Fuller | 405/237 |
| 4,091,661 | A | | 5/1978 | Handy et al. | 73/784 |
| 4,314,615 | A | * | 2/1982 | Sodder, Jr. et al. | 175/94 |
| 4,605,339 | A | * | 8/1986 | Bullivant | 405/237 |
| 4,730,954 | A | * | 3/1988 | Sliwinski et al. | 405/240 |
| 4,770,256 | A | * | 9/1988 | Lipsker et al. | 175/57 |
| 5,145,285 | A | | 9/1992 | Fox et al. | 405/258 |
| 5,249,892 | A | | 10/1993 | Fox et al. | 405/233 |
| 5,608,169 | A | * | 3/1997 | Fujioka et al. | 73/786 X |
| 5,622,453 | A | * | 4/1997 | Finley et al. | 405/240 |
| 5,978,749 | A | * | 11/1999 | Likins, Jr. et al. | 73/11.03 X |

OTHER PUBLICATIONS

Bowles, Foundation Analysis and Design, p. 300, 1988.*
Control of Settlement and Uplift of Structures Using Short Aggregate Piers, Lawton et al., ASCE National Convention, Oct. 9–13, 1994, Atlanta Georgia, pp. 121–132.
ENR Engineering News–Record, The Construction Weekly, Shorter Piles Have Deep Impact, Jul. 1, 1996.
Geopiers Quarterly, Newsletter for the Geotechnical Industry—First Quarter 1997.
Sunil, Singh, International Preliminary Examination Report, Patent Cooperation Treaty, dated Jul. 23, 2001, 18 pages, Washington, D.C., U.S.A.

* cited by examiner

*Primary Examiner*—David Bagnell
*Assistant Examiner*—Sunil Singh
(74) *Attorney, Agent, or Firm*—Banner & Witcoff, Ltd.

(57) ABSTRACT

Methods for augmenting the load bearing characteristics of short aggregate piers include preloading matrix soils, adding chemical additives to matrix soils and using mesh reinforcement in matrix soils and in cooperation with the aggregate lifts associated with pier constructions. Methods for expanding the feasibility of short aggregate piers include the use of gradations of aggregate, reducing friction between the short aggregate pier and adjacent matrix soils using liners or lubricating materials, controlling liquefaction by employing aggregate drains in short aggregate pier constructions, the use of non-impact forces alone or in conjunction with vibratory forces in construction short aggregate pier lifts, and the use of indigenous materials in short aggregate pier constructions. Other methods for augmenting the construction of short aggregate piers include the use of variable dimensioned lifts, the use of interlocking aggregates and recycled materials, such as recycled concrete, the use of temporary casings to protect pier cavities, and the use of load sensors to monitor stresses within short aggregate pier constructions and pressure cells to measure load/deformation characteristics. The invention also includes systems for lateral load stabilization and uplift anchoring utilizes short aggregate pier construction techniques; systems to apply preload to short aggregate piers to increase their stiffness. The invention also includes an apparatus for applying preload to short aggregate pier and matrix soils and other constructions incorporates a pair of half shells operatively associated with an actuator for moving them outward. Once inserted into the pier cavity, the half shells are forced outward to apply preload forces to the pier cavity walls and matrix soil.

13 Claims, 15 Drawing Sheets

FIG.5A
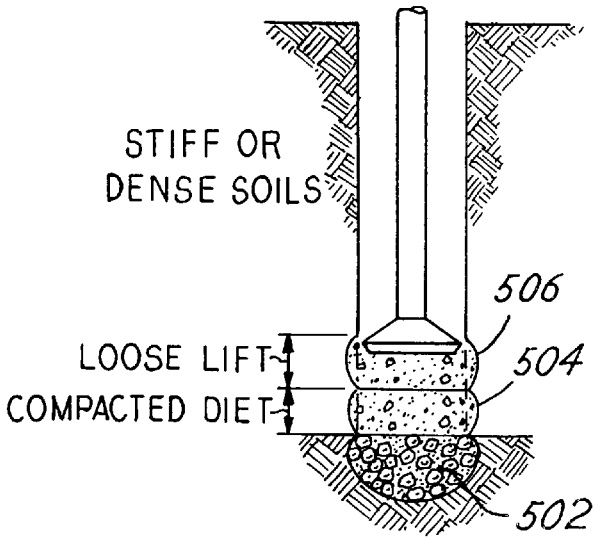
FIG.5B
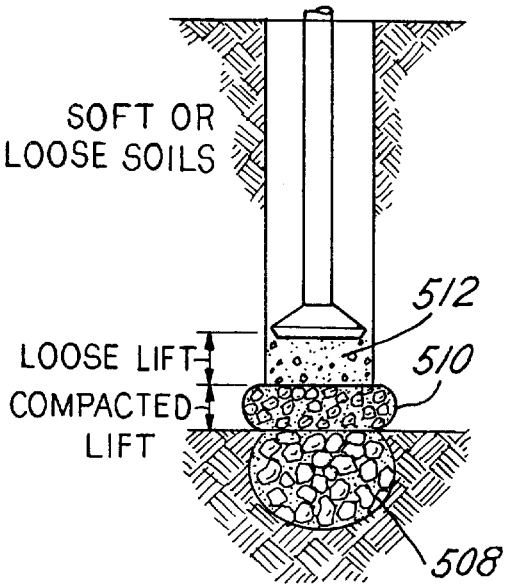
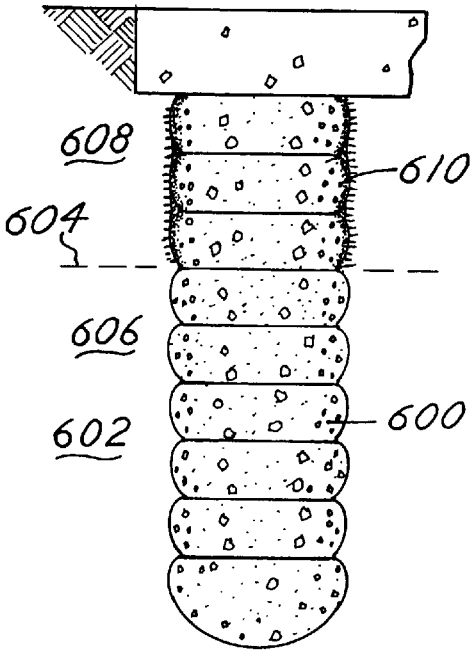
FIG.6A
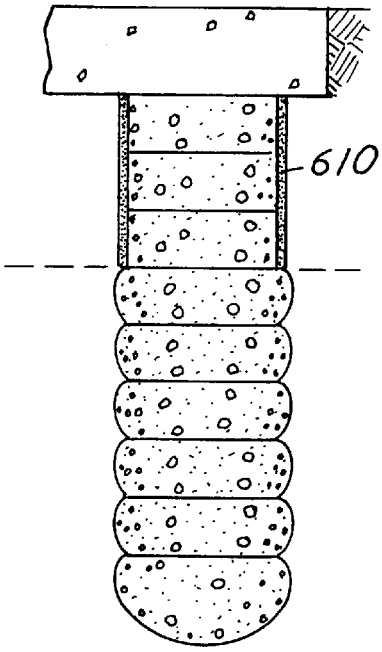
FIG.6B

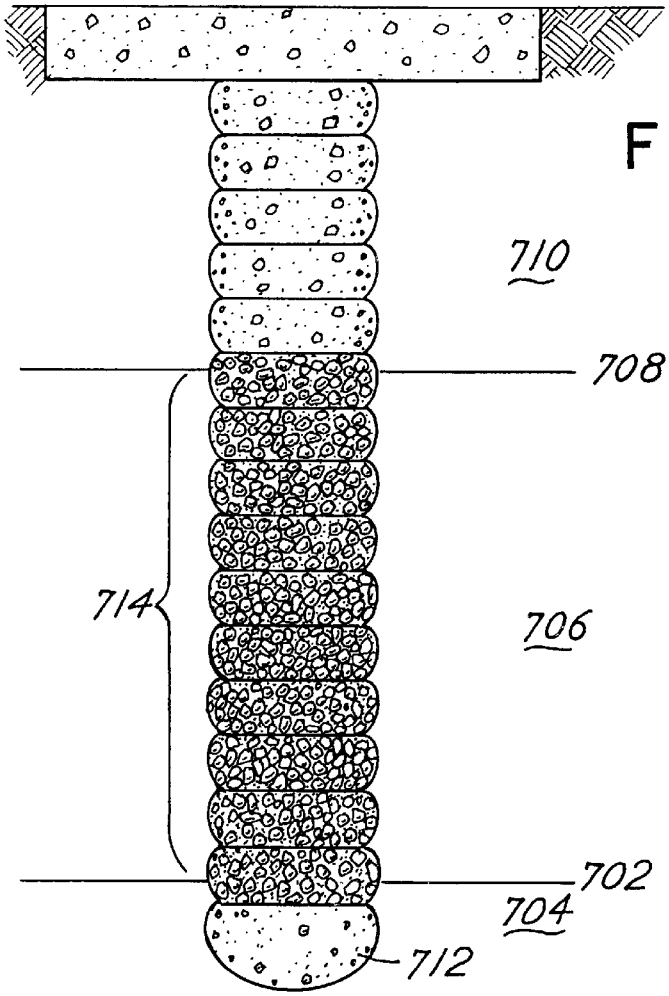
FIG.7
FIG.8B
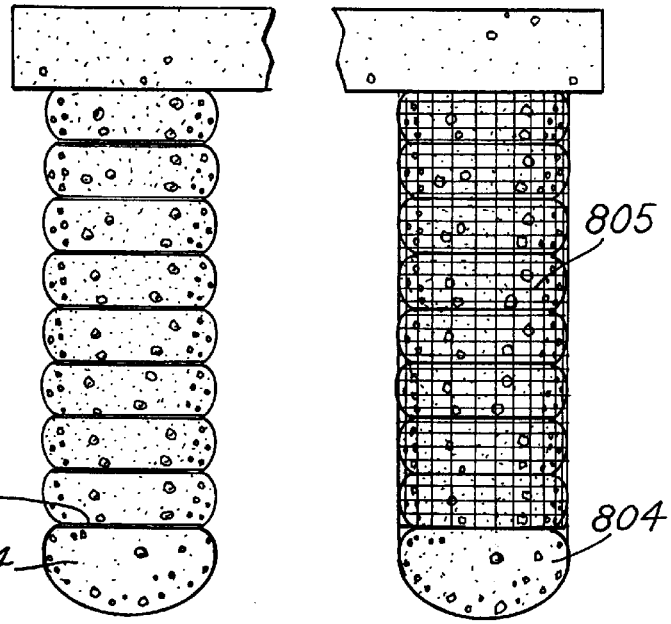
FIG.8A

METHODS FOR FORMING A SHORT AGGREGATE PIER AND A PRODUCT FORMED FROM SAID METHODS

BACKGROUND OF THE INVENTION

This invention relates to earth engineering, especially relative to short aggregate pier implementations. Specifically, this invention relates to methods and apparatus for improving the feasibility of short aggregate piers, improving the strength and load-bearing characteristics of the soil matrix in the vicinity of short aggregate piers, reducing the costs of constructing short aggregate piers, improving the construction of short aggregate piers, and employing short aggregate piers in engineering applications involving settlement control bearing capacity improvement, lateral load resistance, landslide control and uplift anchoring.

It is known to strengthen otherwise inadequate load-bearing capacity of soil by formation of short aggregate piers, such as those disclosed in U.S. Pat. No. 5,249,892, the subject matter of which is incorporated in its entirety herein by reference. Generally, short aggregate piers are constructed in situ by individually compacting a series of thin lifts or layers of aggregate within a cavity formed in the soil. When each lift is compacted, vertical compaction forces are transferred through the aggregate vertically and laterally outward to the surrounding soil. The pier resulting from a vertical "stack" of lifts, each compacted before the next lift is formed and each including aggregate elements which are not cohesive, is characterized by the ability to transfer a relatively large portion of the load outward and laterally into the adjacent, prestressed soil. Short aggregate piers have been recognized in the civil engineering field as revolutionary, partly because they provide for increased load-bearing capacity in soil environments which would otherwise tend to make construction of adequate foundations expensive or unfeasible.

Because short aggregate piers are a relatively recent development, much effort lately has been expended towards improving their feasibility, reducing their cost and expanding their field of use and improving their construction. The present invention provides several unique and novel techniques, which include novel methods and the use of novel apparatus that provide the advantages of improving the feasibility of short aggregate piers, reducing their cost, expanding their field of use and/or improving their construction.

Feasibility of short aggregate piers in certain soil environments is limited by the load-bearing characteristics of matrix soils. These characteristics include the soil shear strength, compression characteristics, compactibility, density and permeability or affinity for water. For example, it has been recognized that, especially in loose or soft soil environments, undesirable degrees of settlement may occur when the bearing load is applied to short aggregate piers constructed according to known techniques. It has also been recognized that in known short aggregate pier constructions, very soft subsoils may result in excessive material construction costs due, for example, to the absorption of a significant amount of aggregate stone into the bottom bulb of the short aggregate pier during the tamping or compaction step of construction. These shortcomings tend to limit the feasibility of known short aggregate pier techniques. Thus, it would be desirable to provide techniques which tend to favorably influence or improve the load-bearing characteristics of matrix soils and/or matrix soils in combination with short aggregate piers. It would further be desirable to provide for construction techniques for short aggregate piers which would tend to expand the feasibility of short aggregate piers across a wide range of soil compositions.

Another problem recognized since the development of heretofore known short aggregate pier techniques relates to "plastic" or "heaving" soil environments. These types of soil matrices are characterized by a high-volume change potential due to the absorption of water. Such soil compositions tend to create the potential for undesirable uplift forces on short aggregate piers and on surrounding matrix soils. Uplift forces are undesirable because supported structural members such as footings, mats, beams and slabs will tend to move upward, causing structural distress and/or cosmetic damage. It would therefore be desirable to provide short aggregate pier techniques which reduce the potential for uplift forces in plastic or heaving soil environments. Yet another limit on the feasibility of known short aggregate pier techniques relates to liquefiable soil environments (i.e. soils which tend to liquefy when subject to sufficient dynamic stress). Typically, engineering codes may require special aggregate drain gradation in structures formed in liquefiable soil environments. Present aggregate drain structures are not constructed in thin lifts and are, as a result, not as efficient in providing settlement control or soil liquefaction control as can be provided using known short aggregate technique with compaction of each lift (the short aggregate pier technique). It would therefore be desirable to provide short aggregate pier techniques which provide the ability to meet aggregate drain gradation requirements.

Another problem recognized with known short aggregate pier construction techniques is that in soft or unstable soil environments, the pier cavity may tend to distort, cave-in, or become otherwise damaged as the pier is formed in situ. It would therefore be desirable to provide for short aggregate pier construction techniques which reduce the potential for damage to the pier cavity during pier construction.

Yet another problem recognized with known short aggregate pier techniques is that the impact loading typically applied to compact each lift during construction of an short aggregate pier may be problematic in areas which are in close proximity to sensitive structures (i.e. older buildings) or buried objects, such as pipes, culverts or conduits. It would therefore be desirable to provide short aggregate pier construction techniques which do not present a danger to damaging nearby sensitive structures.

As short aggregate piers are desirable, in part, because they are economical, it is desirable to provide for construction techniques which reduce the cost of short aggregate piers compared to known construction techniques. It is also desirable to provide construction techniques which maintain the integrity of the matrix soils susceptible to damage during construction. Still further, because of the advantages recognized in known short aggregate pier techniques, it would be desirable to expand the field of use of short aggregate piers to earth engineering areas that include, for example, global stabilization, lateral load resistance, landslide control and uplift control. Finally, it would be desirable to provide methods and apparatus for obtaining stress distribution and other data from short aggregate piers which have been constructed.

SUMMARY OF THE INVENTION

The aforementioned problems and desired advantages are realized by the present invention, which provides several novel and unique methods and apparatus that improve the feasibility of short aggregate piers, improve the strength and load-bearing characteristics of the soil matrix in the vicinity of short aggregate piers, reduce the costs of constructing short aggregate piers, improve the construction of short aggregate piers, and employ short aggregate piers in engineering applications involving settlement control, bearing capacity improvement, lateral load resistance, landslide control and uplift anchoring.

A. Short-Aggregate Pier Construction Techniques for Improving Soil Characteristics.

One aspect of the present invention relates to methods for constructing short aggregate piers to improve the load-bearing characteristics of the soil and to short aggregate pier constructions made by such methods. These techniques include: 1) methods and apparatus for preloading soils and short aggregate piers; 2) methods for providing chemical additives to short aggregate pier constructions; and 3) methods for employing mesh reinforcement in short aggregate pier constructions and short aggregate piers constructed by those methods. These techniques make short aggregate pier implementations more feasible in problematic soil environments.

1. Construction Techniques Using Preloading or Prestraining.

a) Prestraining or Preloading of short aggregate piers.

Short aggregate piers are compressible. When a load is applied, they tend to slightly bulge out, and also to compress vertically within the aggregate as the aggregate densifies. There is also vertical deformation as the adjacent matrix soil strains to mobilize side friction for load resistance through vertical shear resistance. By "prestraining" a short aggregate pier, much of the deformation that occurs is irreversible, and is permanently eliminated. This is because of inelastic deformation within the short aggregate pier itself (densification of aggregate), and inelastic prestraining of the matrix soils adjacent to and underneath the short aggregate pier. The new effect is "stiffening" the pier, so that for the same deformation to occur as occurred the first time it was 'prestrained', a larger load can be applied. Conversely, the short same load applied the second time will result in less deformation because of this prestraining or preloading, and stiffening of the pier.

This has been proven in experiments with full-scale short aggregate piers. A number of load tests have been performed on piers where, after the maximum required load was applied, it was removed and a second load was applied to the same magnitude as the maximum previous load. In some cases the second loading was applied immediately after the first load sequence. In other cases, the second load application was applied one day to several days after the first loading. Deformations were measured for all load increments, both the original cycle and for the second, or prestrain cycle. Typically, about 50% of the total deformation was eliminated when the second load was applied. An additional load that caused the short same deformation which occurred from the first maximum load application was on the order of 150% as great as the magnitude of the first maximum loading.

Likewise, the prestraining may be applied by using an hydraulic jack or other device and jacking against a heavy reaction, such as a heavy piece of equipment, heavy vehicle, or dead weights. It may also be applied by a special apparatus inserted into the short aggregate Pier cavity. This apparatus obtains necessary reaction force by intimate contact with matrix soils adjacent to the cavity, and application of lateral force to the cavity walls while providing a set of shear plates in contact with the soil. It may also be applied by dynamic force such as a controlled explosion or by dropping weights.

b) Prestressing and Prestraining of Piles, Drilled Piers (Caissons), "Stone Columns", And Other Foundation Elements.

A similar second or multiple re-application of load will likewise result in prestraining the matrix soil and preloading the foundation element-matrix soil system. For relatively incompressible materials such as steel and concrete, there will be no significant inelastic permanent deformation in the element itself. However, within the adjacent matrix soil and underlying matrix soil such a preloading will cause inelastic deformation and prestraining, which will result in either reducing future deformations under identical loads or in allowing increased loads to be applied to result in the short same deformation magnitude as originally occurred.

These prestressing and prestraining relationships discussed above for piles, drilled piers, and other incompressible foundation elements have been proven in a number of special sort aggregate pier load tests where 'tell-tales' were installed. The 'tell-tales' (see # 14 below) are steel plates and rod devices, placed at the bottom of the tested pier to determine the magnitude of deflection occurring be low the pier bottom. The difference between magnitude of deflection at pier bottom and magnitude of deflection at pier top is equal to compression within the pier upon loading. During the re-cycle test it can be shown that the magnitude of total deflection (deflection measured at short aggregate pier top) exceeds the magnitude of pier compression deformation caused by compression of the pier itself (equal to the magnitude of deflection measured at short aggregate pier top minus magnitude measured). The difference between total deflection measured in the re-cycle test and pier compression deformation represents the reduced deflection which would have occurred if the short aggregate pier were incompressible, as essentially is concrete and steel (in comparison with soil). This shows that prestraining and preloading other foundation systems will result in less vertical deflection occurring under the short same load when a second load is applied, or more load is available to produce the same amount of deflection for a second load application. The prestraining application may be applied by jacking against a heavy reaction or by a special apparatus, both as described in (a) above. It may also be applied by dynamic force, such as a controlled explosion or a dropping weight.

2. Construction Techniques Using Chemical Additives.

Chemical additives can be added to the aggregate in short aggregate piers, whether by mixing with the aggregate, or by placing in lifts between aggregate lifts, or by placing in the cavity at the periphery of the aggregate. The chemical additives will react and combine with both the aggregate and the adjacent matrix soils. The reaction of chemical to soils is generally understood for most chemical additives that are to be used with this method, including cement, hydrated lime, quicklime, and flyash. For example, quicklime may be added to the aggregate pier to improve the shear strength and compressibility characteristics of the adjacent matrix soils. The end result is an improvement in soils strength and in the reinforcement efficiency of the chemically-aided short aggregate pier system.

3. Short Aggregate Pier Construction Techniques Using Mesh or Geofabric Reinforcement.

Geogrids or synthetic or metal mesh or geofabric may be used placed horizontally between aggregate lifts to increase the short aggregate pier stiffness, or vertically within the perimeter of the short aggregate pier to reduce bulging of the pier in very soft, compressible matrix soil materials. Use of geogrids or synthetic or metal mesh or geofabric materials within short aggregate piers will result in efficient and effective tension resistance and resulting effective increase in lateral shear resistance and pier stiffening. Geogrids have been used in an experimental short aggregate pier modulus load test. The result showed a restraint in bulging and lateral displacement of the pier when the pier was wrapped with geogrid placed vertically along the perimeter of the short aggregate pier.

B. Short-Aggregate Pier Construction Techniques for Expanding The Feasibility of Short Aggregate Piers.

Another aspect of the present invention relates to methods for constructing short aggregate piers to expand the feasibility of short aggregate pier constructions. These techniques include: 1) short aggregate pier construction techniques using selective gradations of aggregate; 2) short aggregate pier construction techniques for reducing friction; 3) short aggregate pier construction techniques for controlling liquefaction of soil; 4) Non-impact short aggregate pier construction techniques; and 5) the use of sand, soil, low slump or no slump, "roller concrete," or other indigenous materials in short aggregate pier constructions. These techniques employing short aggregate pier implementations expand the feasibility of short aggregate piers to a broader range of soil environments than prior art techniques.

1. Short Aggregate Pier Construction Techniques Using Selective Gradations of Aggregate.

The present invention relies on the discovery by the present inventor that constructing a short aggregate pier to maximize effectiveness as a soil reinforcement element requires the use of different gradations of aggregate-both for use below the water table and for construction of the bottom bulb which is part of the short aggregate pier. "Washed" or "clean" stone, such as 1 to 1.5 inch maximum size graded stone in which the fine sands, silt and clay fractions have been removed or are limited to small percentages, are typically used for the bottom lift constructions in forming a "bottom bulb." If the subsoils are very soft, the 1 to 1.5 inch washed stone which has been used in prior art techniques to create the bottom bulb, results in a bulb which is too deep because of the excessive energy of the tamper in relation to the bearing capacity of the very soft soils. For this situation, a larger stone, such as a 3 or 4 inch minus stone is substituted for the 1 to 1.5 inch diameter stone. The result is a shorter bulb and a dampening out of the tamping energy by the larger stones. Another technique that may be used is to mix two or more gradations of stone together to produce a more desired gradation of stone. An example may be #57 stone (1 to 1.5 inch maximum sized, washed stone) mixed with #68 stone. Yet another techniques is to layer different gradations of stone on one another. One may begin with the larger, 3 or 4 (or 6) inch diameter stone. After one or more lifts of this stone, one may add the 1 to 1.5 inch diameter washed stone. After one or more lifts of this stone, one may add highway well-graded base course stone.

2. Short Aggregate Pier Construction Techniques For Reducing Side Friction.

Normally, a short aggregate pier is intended to generate as much side friction as possible with the adjacent matrix soils to assist in resisting vertical compressive forces or vertical uplift shear forces. However, when soils are of high volume change potential (also knows as "plastic" or as "heaving soils."), the active upper zone of these soils, which is the zone that changes volume because of moisture change, tends to pull up or lift the aggregate pier. For this portion of the pier (not for the underlying, lower portion of the pier), it is advantageous to reduce the side friction between the short aggregate pier and the matrix soil. According to the present invention, this can be accomplished with the use of space-age polymers, or with BENTONITE or other lubrication materials. The invention also contemplates the use of liners made of cardboard, plastic, or metal to reduce side friction within the active zone.

3. Short Aggregate Pier Construction Techniques For to Controlling Liquefaction.

Short aggregate piers can be constructed to meet aggregate drain gradation requirements. They may also be constructed so that a portion of the short aggregate pier within liquefiable soils, meets the aggregate drain gradation requirements while other portions that are adjacent to soils that are not liquefiable, do not have to meet such gradation requirements. What makes this type of aggregate drain unique is that it is a short aggregate pier "aggregate drain", and therefore meets all requirements of a short aggregate pier—i.e., constructed within a cavity, constructed with granular materials placed in thin lifts, and constructed by tamping the lifts to densify them and to prestrain and prestress adjacent and underlying soils.

The use of special gradation to produce liquefaction control is a known method of controlling liquefaction. However, to date, no one has constructed short aggregate piers with thin lifts of aggregate compacted on each lift—and meeting aggregate drain gradation requirements Such aggregate drain short aggregate piers will have the advantage of greater strength, greater matrix soil strength, and less compressibility than normal aggregate drains that are either not compacted at all, or are compacted only in thick lifts (generally 6 to 10 feet thick or more). It has been shown that increased aggregate drain densification results in more effective aggregate drains. Such will be provided with short aggregate piers incorporating aggregate drain gradation.

4. Non-impact Short Aggregate Pier Construction Techniques.

Known methods of making short aggregate piers use dynamic impact forces produced by impact ramming action. When sensitive structures or objects such as buried conduits, buried culverts or piping, old historic buildings, etc. are either underground, partially underground, or on top of the ground, and in the proximity of the short aggregate piers, then static piers may be constructed, or static piers with a vibrating tamper can be constructed. The short aggregate pier thus constructed will generally not be as effective in controlling settlements or controlling uplift or lateral forces as will the impact-constructed short aggregate pier of the same diameter and shaft length. However, this modified technique will protect sensitive objects in the vicinity of the short aggregate pier construction location. Total capacity of the system can be made comparable to the impact short aggregate pier system, even though the capacity per square foot of planar area is less, This can be accomplished by: 1) increasing the number of piers supporting the same structure: 2) increasing the average diameter of each pier; 3) reducing the thickness of the pier lifts; 4) using geogrid or mesh; or 5) a combination of these methods.

Applying a limited amplitude vibrating source to the static load-applying tamper or tamper shaft will generally make the short aggregate pier stiffer than it would be with static load alone, but not as stiff as it would be with dynamic impact forces and ramming action. Lifts can be done in such a way that resulting stresse s which could damage adjacent sensitive structures are reduced compared with those produced from dynamic impact loads in order that adjacent sensitive structures are not damaged.

5. The Use of Sand, Soil,"Roller Concrete" and Other Indigenous Materials In Short Aggregate Pier Construction.

In addition to stone aggregate, sand, soil, chemically-treated soils or "roller concrete" may be used as building materials for short aggregate piers. The sand or other soils may be imported from commercial sources, or they may be indigenous to the construction site or immediate area. "Roller concrete" may be manufactured on site or brought to the site from a mixing plant. The basic steps in making a short aggregate pier, of creating a cavity, densifying and prestraining/prestressing soils at the bottom of the cavity, and building up the short aggregate pier shaft by placing materials in thin lifts and densifying them, still remains. The difference is that these materials need not be stone aggregates. Laboratory and small-scale field experiments have shown that sand, chemically-treated sand, and chemically-treated soils (silts and clays), and soils with synthetic inclusions mixed within the soils or placed in layers, can be effectively used as short aggregate pier building materials. The chemicals most often used in the experiments, and considered to be the most practicable for production of short aggregate piers, are cement, hydrated lime, quicklime, and flyash. "Roller concrete," being low moisture content, low slump or no slump concrete, behaves in a similar fashion to soil, and may be placed and compacted in thin lifts.

C. Short-Aggregate Pier Construction Techniques for Reducing The Cost of Short Aggregate Piers.

Yet another aspect of the present invention relates to methods for reducing the cost of short aggregate piers or improving their construction. These techniques include: 1) short aggregate pier construction techniques using variable diameter lifts; 2) short aggregate pier construction techniques using recycled, interlocking concrete aggregates; 3) short aggregate pier construction techniques employing casings to protect the pier cavity; and 4) short aggregate pier construction is techniques employing load sensors, load cells, or pressure cells within, adjacent to, or below the short aggregate pier structure. These techniques reduce the cost or otherwise improve the construction of short aggregate piers.

1. Short Aggregate Pier Construction Techniques Using Variable Diameter Lifts.

Known short aggregate piers have been made with a single diameter or a similar rectangular cross section shape. By designing and constructing piers with two or more diameters, or two or more rectangular cross section areas, the smaller diameter or cross section area being within the lower portion of the pier, and the larger diameter(s) or cross section area above, will allow more efficient use of stone and tamping energy. Stresses from structural loading are known to dissipate or lessen with depth within short aggregate pier elements. By creating short aggregate piers with smaller diameters in lower portions, (or smaller rectangular cross section areas) one can take advantage of the lower magnitude of stresses and save time and costs related to: (1) aggregate materials, (2) to drilling, and (3) to required compaction efforts.

2. Short Aggregate Pier Construction Techniques Employing Recycled or Interlocking Concrete Aggregate.

A practicable substitute for commercial, graded aggregate in short aggregate pier construction is to use recycled, and re-crushed graded concrete. The advantages of this include: 1) the cost of re-cycled concrete is normally significantly less than processed commercial graded aggregate, in cost per ton of material; 2) the edges of re-cycled concrete are often sharp, and often sharper than corresponding edges of commercial graded aggregate. This is particularly true when commercial aggregate source is a glacial or alluvial stone with some rounded surfaces. Sharper edges results in greater frictional shear and more effective interlocking between particles. This in turn, results in stronger short aggregate piers; 3) another advantage recognized by the present invention is that the chemicals contained in the original concrete typically including Portland cement and lime, are still partially active after many years of concrete usage. These chemicals improve the aggregate by both forming a binder or cementing action within the aggregate itself, and also by combining chemically with the adjacent soils.

3. Short Aggregate Pier Construction Techniques Employing Casings to Protect the Pier Cavity.

Temporary casings may be used to keep short aggregate pier cavities open during construction of the short aggregate pier. A unique requirement of the use of casing is that the casing must be lifted in short vertical increments essentially equal to the lift thicknesses of the placed aggregate, This allows for lateral soil prestressing, prestraining, and densification, during compaction of each lift. This lateral prestressing and prestraining would not be possible if the liners were not lifted during compaction of each lift. Additionally, lifting the liners prevents the liners from containing densified aggregate "plugs" which occur if aggregate is compacted within the temporary casings. These "plugs" either cannot be removed, or are very difficult to remove because of the high lateral force on the liners and the high coefficient of friction between the aggregate and the liner. The casing may be lifted by special lifting apparatus such as a crane, a forklift, an excavator, or other piece of construction equipment.

4. Short Aggregate Pier Construction Techniques Employing Load Sensors or Pressure Cells Within the Pier Structure.

In accordance with the present invention, load cells or load sensors may be placed within short aggregate piles to determine stress levels within different depths of a short aggregate pier. These data can be used to evaluate stress distribution within short aggregate piers, which in turn can be used to better understand how short aggregate piers work, and proper designation of pier capacities. In addition, pressure cells may be installed within portions of short aggregate piers. These pressure cells may be activated, causing pressure to expand the cells and push upward and downward on portions of the short aggregate piers. This will cause movement or deformation of the short aggregate piers. Measurement of these movements provides information concerning stiffness of the pier and capacity of the pier which can be used in design of the pier. Tell-tales, consisting of a bottom member fixed to vertical members, can be emplaced within short aggregate piers to measure displacements or deformations occurring below the telltales during load testing or during actual structural loadings. This can be used to better estimate and understand the load-deformation characteristics of short aggregate piers.

5. Techniques For Testing Characteristics of Short Aggregate Piers.

Also in accordance with the present invention, techniques are provided for testing characteristics, such as stiffness, of short aggregate piers, also known as a GEOPIER. In a preferred embodiment of the invention, a load transmitting element (normally the tamper assembly) is provided in tandem with a calibrated pressure or load measuring device on the pier to determine magnitude of applied load. A deflection measuring device is provided on load transmitting element or on other reference location integral with top of short aggregate pier. When a load is applied through the load transmitting element to the top of pier, the load is measured with the load measuring device and the downward deflection of the pier is measured with the deflection measuring device. The pier stiffness may be calculated from the measured load and deflection.

The unique aspects of this feature of the invention provide for verification of characteristics, such as the stiffness modulus, of short aggregate piers, in situ. The invention provides the ability to combine a deflection measurement data with load or pressure measurement data to verify the modulus of the short aggregate pier immediately after construction In the case of inadequate or unacceptable stiffness, stiffness can be increased by re-application of densification energy, including possible partial re-drilling and re-building of pier. Alternatively, insufficient pier stiffness may be taken into account in the design, and the pier may remain as it is, with less capacity than originally designed.

D. Using Short Aggregate Piers For Lateral Load Resistance And As Uplift Anchors In accordance with yet another aspect of the invention, short aggregate piers its are employed in applications for global soil stabilization, lateral load resistance and landslide control and as uplift anchors.

1. Global Stabilization, Lateral Load Resistance and Landslide Control.

Full-scale field shear tests within short aggregate piers show that the shear strength available within short aggregate piers is unusually high with friction angles above 50 degrees with highway base course stone, and 48 degrees for washed 1 to 1.5 inch diameter stone. This very high shear strength provides the capacity of the short aggregate piers to resist lateral forces and to resist shear forces. As a result, the short aggregate pier is very efficient in providing global stability to resist a global or internal shear failure. Short aggregate piers are also efficient in providing resistance to landslides and to lateral load restraints such as when foundations supported by short aggregate piers are loaded laterally. The coefficient of friction in this latter case is essentially equal to the tangent of the friction angle of the aggregate pier itself. Another factor which contributes to the lateral load resistance and global stability provided by the short aggregate piers is the stress concentration which occurs within the piers.

2. Uplift Anchors.

The short aggregate pier, when equipped with a"harness" or device for transferring load from the pier bottom to the structure undergoing uplift forces, acts as a very efficient uplift anchor. The device or harness consists basically of a bottom plate or series of plates, fixed with vertical bars or tubes that transfers forces to the footing, slab, or beam that needs uplift resistance. The short aggregate pier, with its high coefficient of friction between itself and the matrix soil, provides an exceptionally efficient uplift anchor per foot of depth. Another factor contributing to the effective uplift force resistance of the short aggregate pier is the build-up of lateral soil stresses which occur during the short aggregate pier installation. These anchors may be permanent or temporary, depending on usage. A number of experimental uplift load tests have been performed which confirm the high uplift capacity provided by the short aggregate pier system equipped with stress transfer mechanisms.

Other advantages, novel features, and the further scope of applicability of the present invention will be set forth in the detailed description to follow, taken in conjunction with the accompanying drawings, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF THE DRAWINGS

The accompanying drawings which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings, in which like numbers refer to like parts throughout:

FIGS. 5A–5B illustrate a process of providing gradations of aggregate according to another preferred embodiment of the present invention;

FIGS. 6A –6B illustrate a process and apparatus for reducing friction in an short aggregate pier configuration according to preferred embodiments of the present invention;

FIG. 7 illustrates a short aggregate pier method for liquefaction control according to another preferred embodiment of the present invention;

FIGS. 8A–8B illustrate a process and apparatus for employing mesh inserts for stiffening short aggregate piers and matrix soils according to a preferred embodiment of the present invention;

Figure 15:
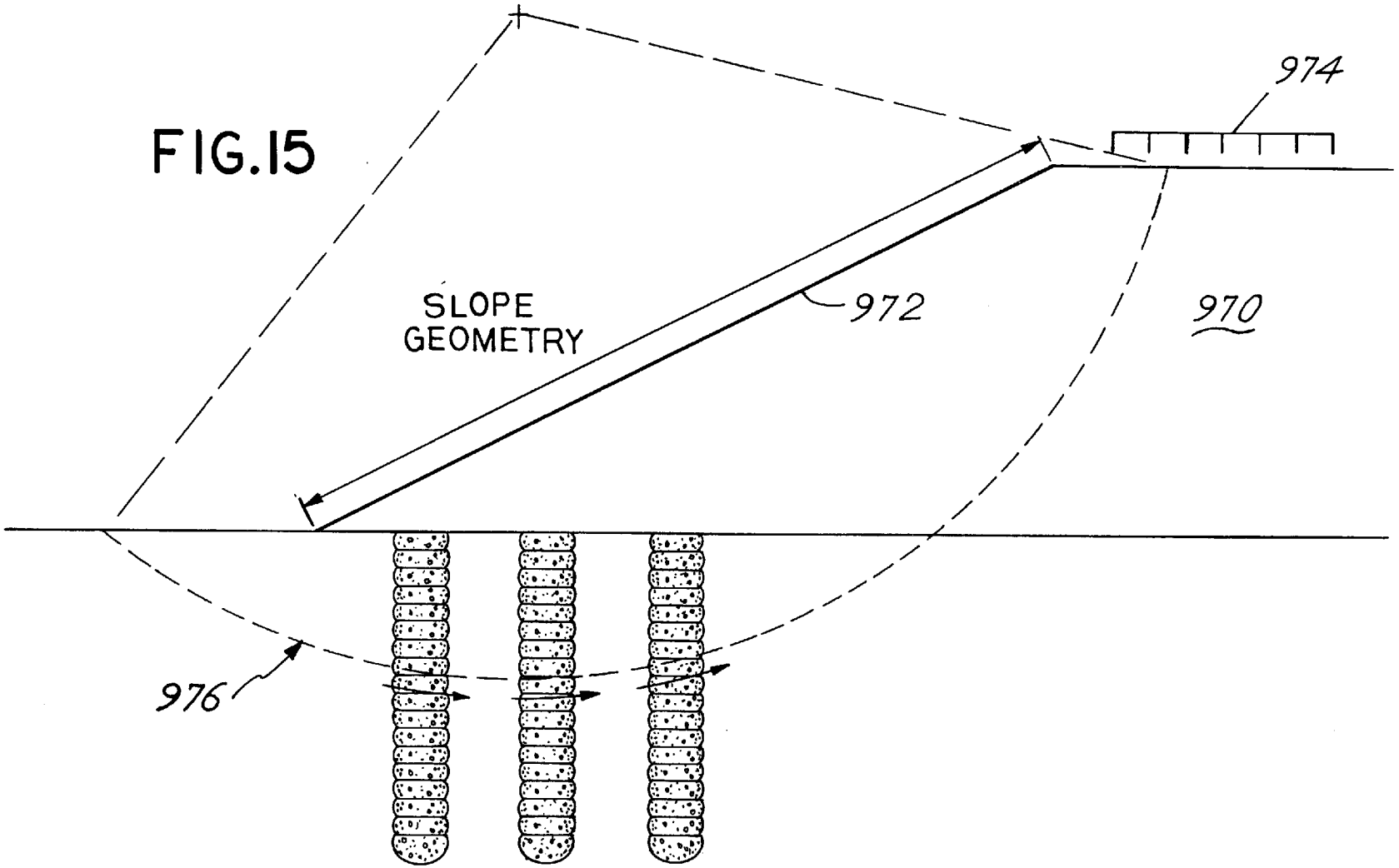
Figure 16:
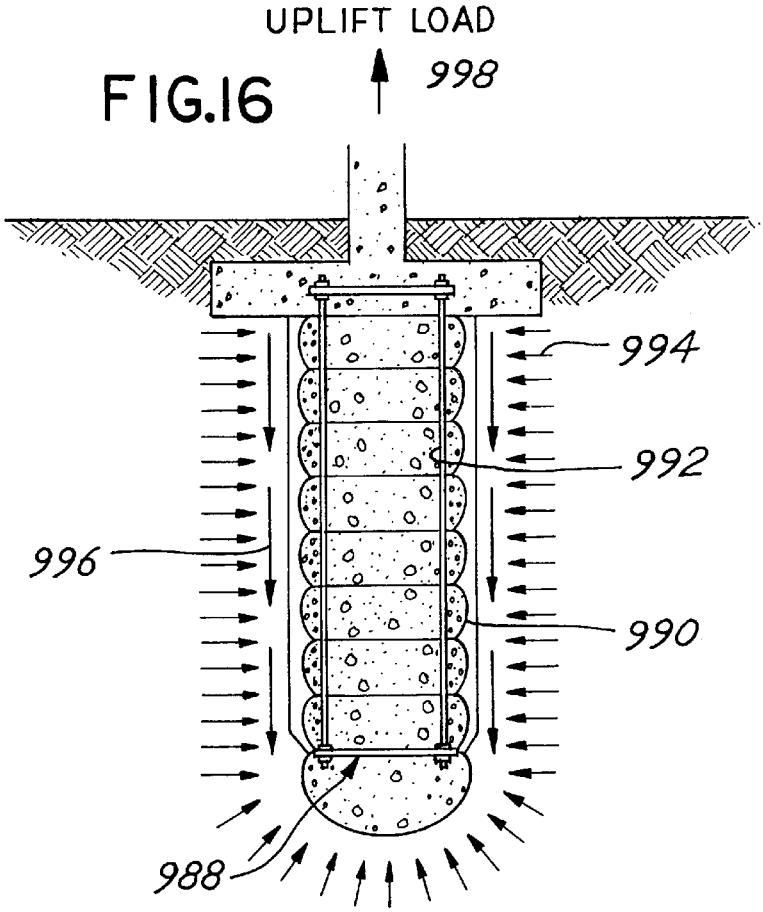
Figure 17:
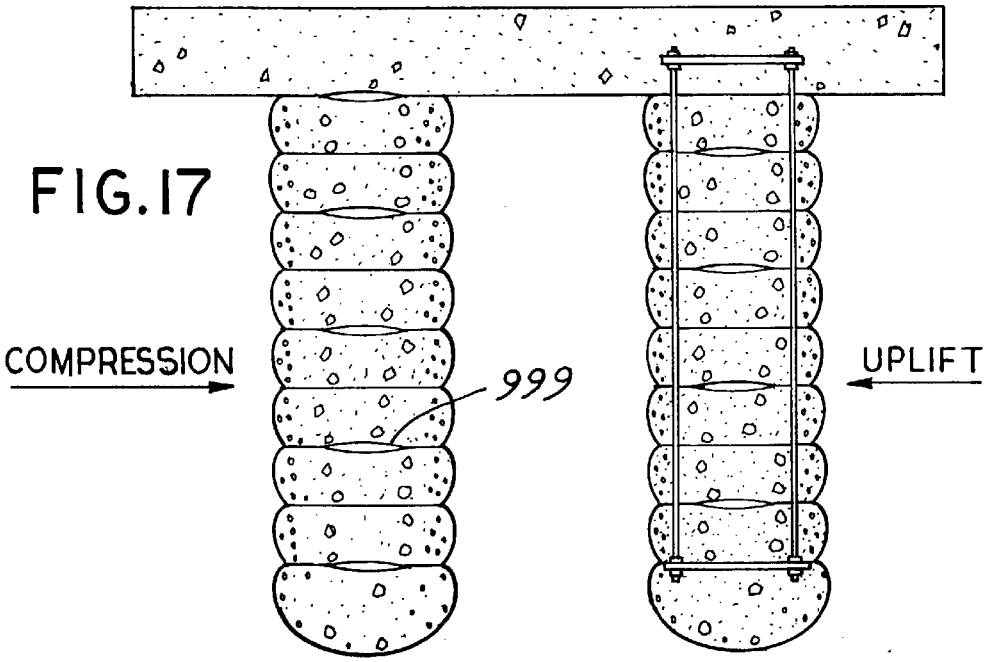
Figure 18A:
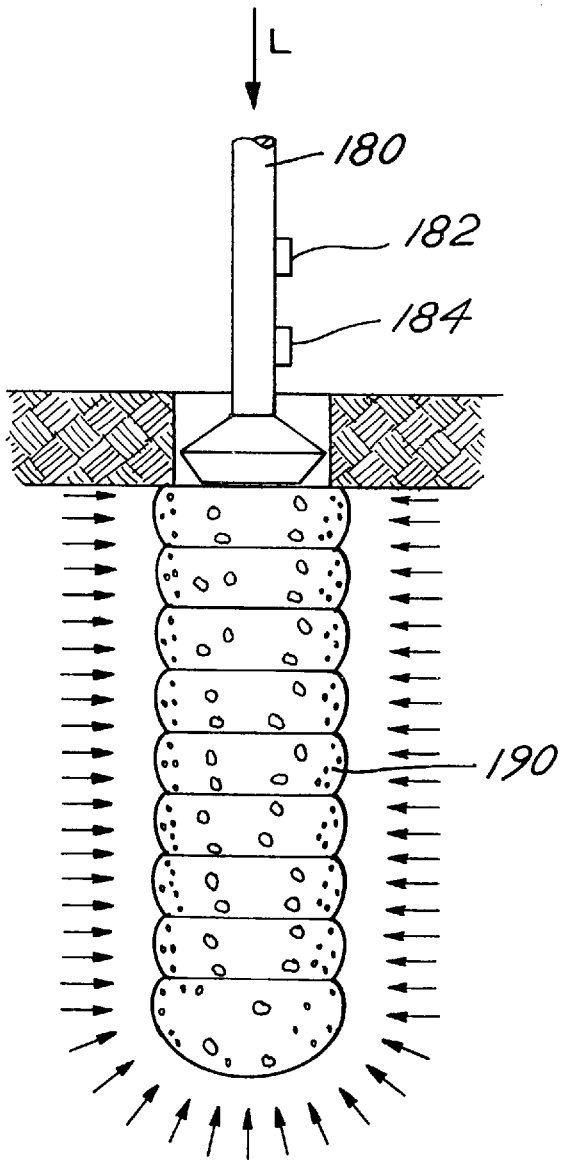
Figure 18B:
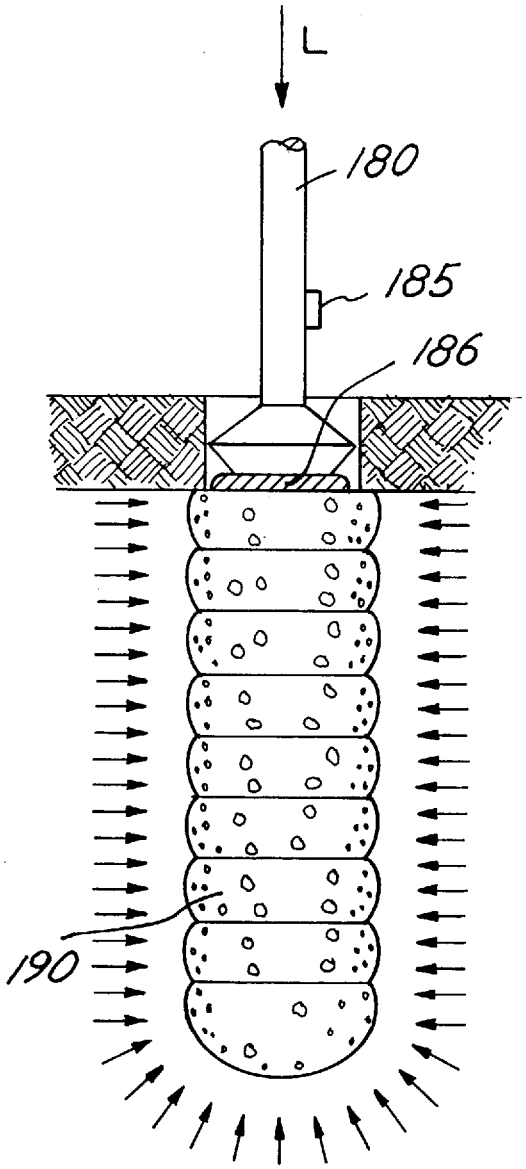

to FIG. 15 illustrates a process and apparatus for providing landslide control using short aggregate piers according to a preferred embodiment of the present invention;

FIG. 16 illustrates a process and apparatus for providing uplift control using short aggregate piers according to a preferred embodiment of the present invention;

FIG. 17 illustrates a process and apparatus for employing load cells, pressure cells, or stress detection sensors in short aggregate piers according to a preferred embodiment of the present invention; and FIGS. 18A and 18B illustrate techniques for determining the characteristics of short aggregate piers.

DESCRIPTION OF THE PREFERRED EMBODIMENTS

Figure 1A:
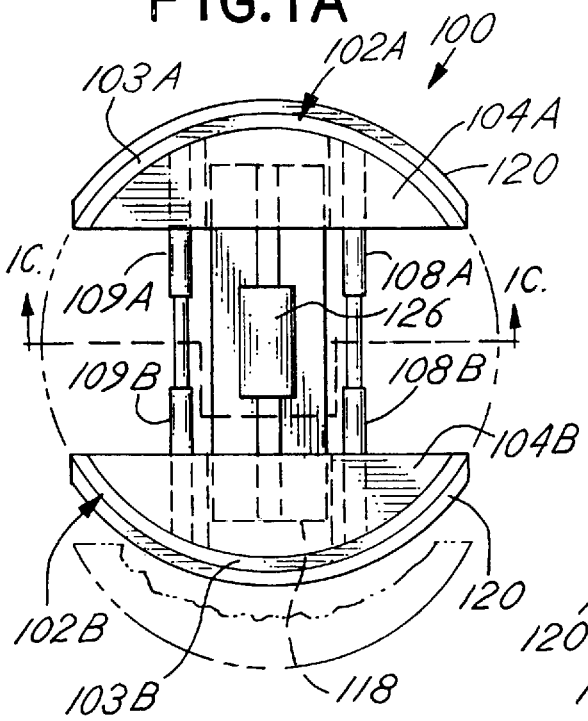
FIGS. 1A–1D are front, top, side, and cross-sectional views of the preloading apparatus according to a preferred embodiment of the present invention.
Figure 1B:
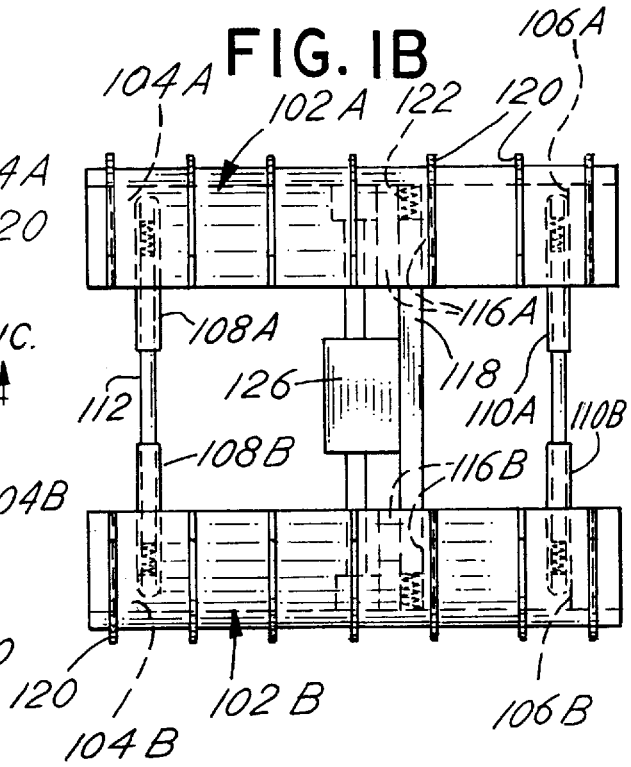
Figure 1C:
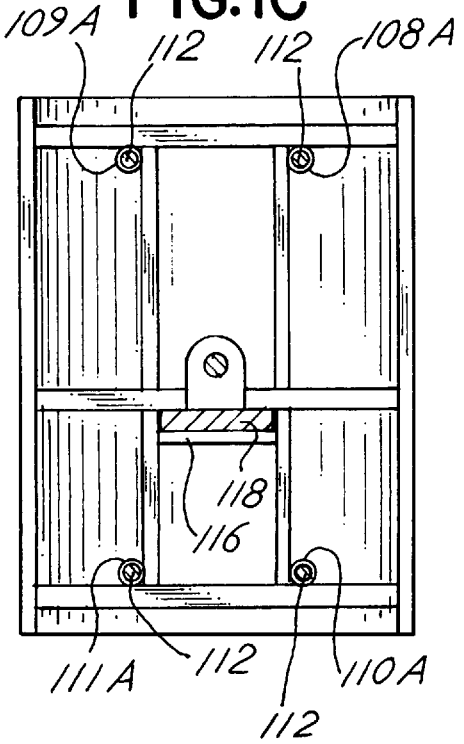
Figure 1D:
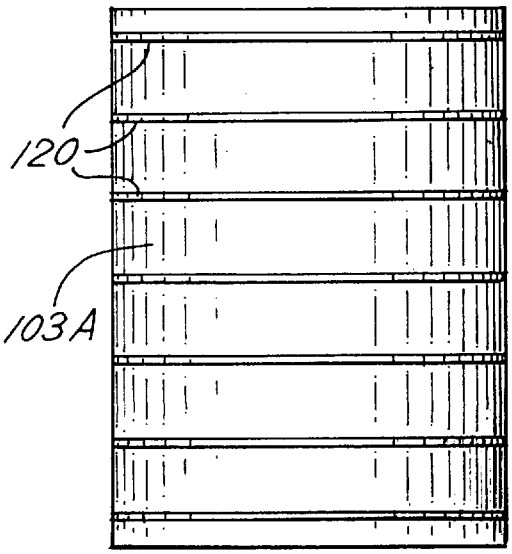

FIGS. 1A through 1D illustrate an apparatus for preloading and prestressing matrix soils in an short aggregate pier cavity. FIG. 1A is a top view. Preloading apparatus 100 is comprised generally of a pair of half shells 102A and 102B which are movably fastened to one another to provide for inward and outward movement against the walls of the short aggregate pier cavity 101. Half shells 102A and 102B are identical and, therefore, only one half shell will be described herein, it being understood that the opposing half shell has equivalent parts. Half shell 102A is comprised generally of an outer cylindrical wall 103A which is provided with a series of substantially horizontal protruding rib elements 120. The purpose of rib elements 120 is to improve the shear resistance imparted to the cavity wall 101. Cylindrical wall 103A is reinforced with a series or matrix of horizontal and vertical flanges. An upper flange 104A is provided with a generally circular periphery which is shaped to fit the inside of cylindrical wall 103A. Upper flange 104A may be fastened to the outer cylindrical wall 103 using conventional means such as welding or threaded fasteners. Referring additionally to FIG. 1B, a lower flange 106A is secure to the lower portion of outer cylindrical wall 103A in a fashion similar to upper flange 104A. Upper and lower flanges 104A and 106, respectively, provide reinforcement to the outer cylindrical wall and, as will be described below, provide a surface to which telescoping members may be affixed to guide and stabilize the movement of the half shells 102A and 102B relative to one another when they are inserted into the short aggregate pier cavity.

Upper guide tubes 108A are secured to a lower surface of upper flange 104A by suitable means such as welding brackets and threaded fasteners. Similarly, lower guide tubes 110A are secured to an upper surface of lower flange 106A. Each guide tube cooperates with a guide rod which is situated or telescoping movement therewith. As can best be seen in FIG. 1B, each guide rod 112 has ends which are inserted into opposing guide tubes 108A, 108B. In the embodiment illustrated, four guide rods and four pairs of guide tubes are arranged to provide for guiding movement and stabilization of the outer cylindrical wall 103A. As can be seen in FIG. 1B, the ends of each guide rod 112 are abutted by a resilient means such as a spring or elastomeric material which has the function of stabilizing the movement of the guide rod relative to the guide tube as the cylindrical wall half shells 102A and 102B move inward and outward relative to one another.

Arranged between half shells 102A and 102B is a horizontal bearing plate 118 which is arranged to cooperate with channel members 116A and 116B on each of the half shells 102A and 102B. Channel members 116A and 116B may be formed each as a rectangular box which is fastened to the half shells 102A and 102B having such internal dimensions that the bearing plate 118 may be slidably received therein. Resilient elements are arranged within the bearing plate channel members 116A and 116B and adapted to abut ends of the bearing plate 118 to stabilize movement thereof. The function of resilient elements 122 is to prevent "sticking" of the bearing plate within the channels 116 when the half shells 102A and 102B are forced outward away from one another. As will be recognized by those of ordinary skill in the art, the bearing plate 118 provides a support surface 124 upon which an actuator 126 such as a hydraulic ram, jack piston or other extending member may be provided to provide the outward force which causes the half shells 102A and 102B to move forward away from each other or together and to thereby provide the prestressing forces on the walls of the short aggregate pier cavity 101.

Figure 2A:
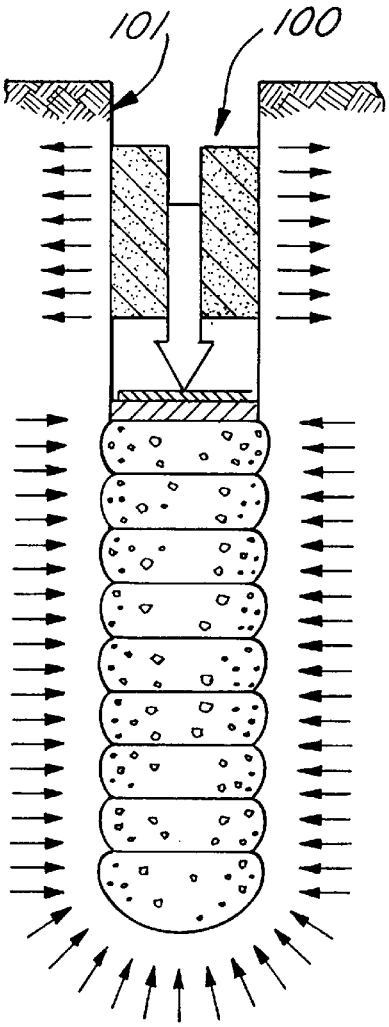
FIGS. 2A–2C illustrate steps of a process of preloading short aggregate piers according to a process of a preferred embodiment of the present invention.
Figure 2B:
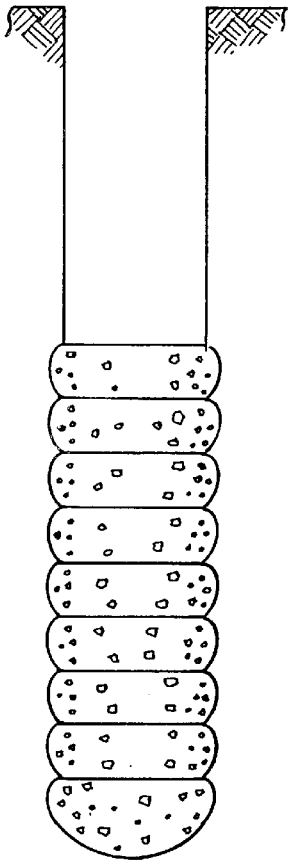
Figure 2C:
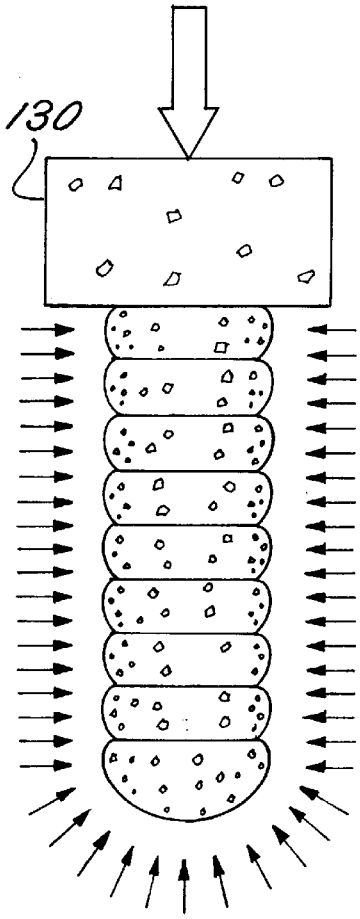

In operation, the aforementioned apparatus is first configured such that the distance between the half shells 102A and 102B is minimized and the actuator 126 will have its minimal length. The preloading apparatus 100 is then lowered into a short aggregate pier cavity 101 using conventional means, such as a crane or boom. Referring now to FIG. 2A, once the preloading apparatus 100 is inserted in place both a lateral stress and a vertical stress are applied to the GEOPIER. Lateral stress is applied by the preloader apparatus 100 by actuating the actuator 126 to cause outward relative movement between half shell elements 102A and 102B. Simultaneously, a vertical load is applied to a steel plate which is placed temporarily on top of the completed short aggregate pier. After suitable load has been applied in both the vertical and lateral directions, the preloader apparatus is retracted, by reverse actuating the jack piston 126. The preloader apparatus and the temporary steel plate are then removed and, referring to FIG. 2B, the prestressed cavity is now ready to support the structural element (such as a footing). Referring to FIG. 2C, the structural footing 130 is applied to the upper surface of the pier. Then the structure is constructed on the footer thereby applying the structure load through the footing through the pier.

Figure 3A:
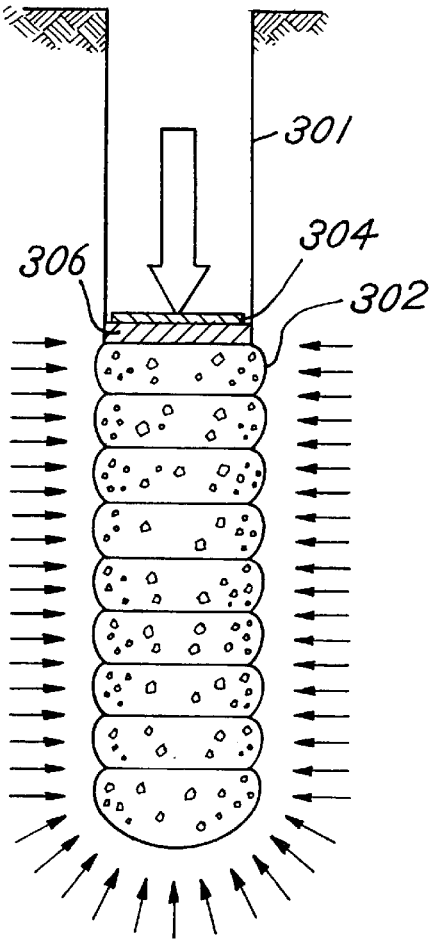
FIGS. 3A–3C illustrate a process of external preloading according to a preferred embodiment of the present invention.
Figure 3B:
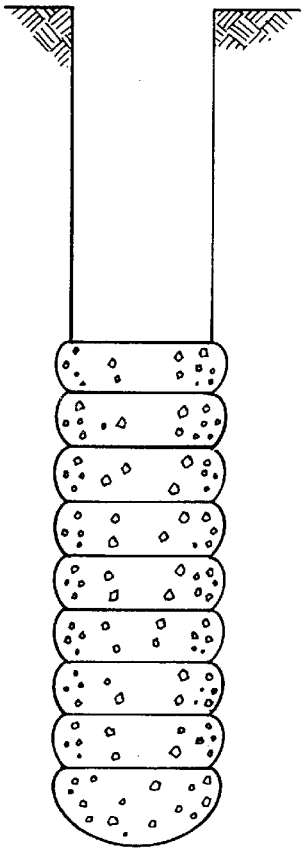
Figure 3C:
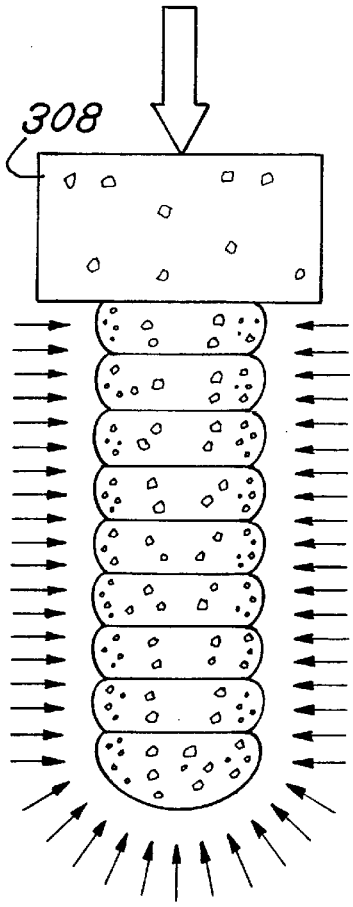

FIGS. 3A through 3C illustrate a process of external preloading according to a preferred embodiment of the present invention. Referring to FIG. 3A, preloading of the completed pier on the uppermost lift of the pier, the lift being referenced by numeral 302, is accomplished by the use of a steel plate 304 situated on top of a planar element 306 to provide preloading of the installed pier after pier construction. According to the preferred embodiment of the present invention, the process proceeds as follows: first, the aggregate materials that comprise each lift are placed and compacted inside the short aggregate pier cavity 301. Then element 306 and steel plate 304 are placed atop the aggregate. Next, a downward force is applied to the pier using a conventional loading apparatus, such as a hydraulic ram or by placing a piece of large machinery on top of the GEOPIER so as to concentrate downward force on the steel plate 304. After preloading has been performed on the pier, the steel plate in element 306 is removed. As shown in FIG. 3C, the placement of a footer 308 is subsequently constructed on the pier. In this way, the structural load is applied through the footing to the pier.

Figure 4A:
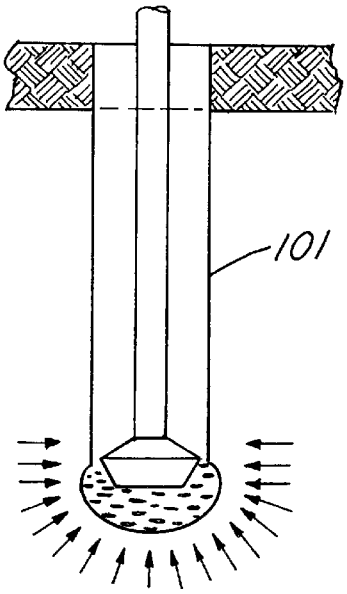
FIGS. 4A–4D illustrate a process of providing chemical additives to the aggregate in a short aggregate pier configuration according to a preferred embodiment of the present invention.
Figure 4B:
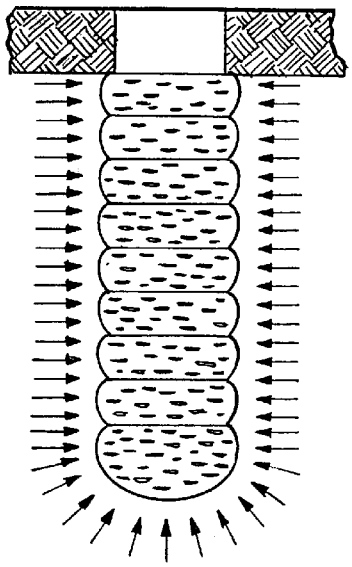
Figure 4C:
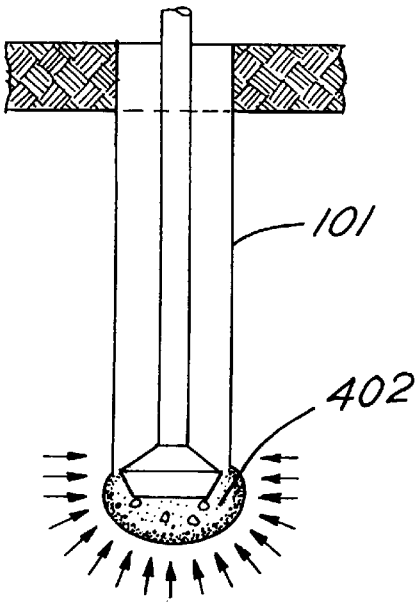
Figure 4D:
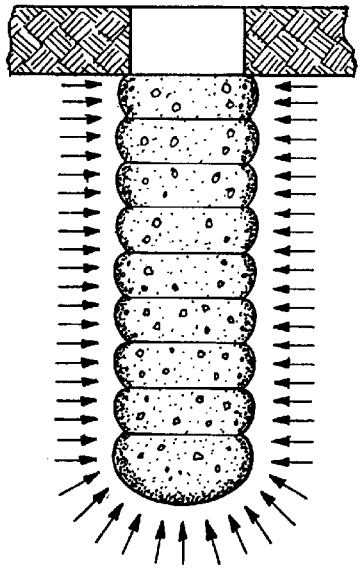

FIGS. 4A and 4B illustrate the process of providing chemical additives to the aggregate in the short aggregate pier configuration according to a preferred embodiment of the present invention. As shown in FIG. 4A, chemical additives are added to the aggregate in forming each of the lifts of the GEOPIER. Suitable chemical additives may include cement, hydrated lime, quicklime, flyash, etc. Referring to FIG. 4B, the resulting pier includes lifts which each include appropriate mixture of chemical additives and aggregate to arrive at the appropriate soil strengthening and stabilizing characteristics. FIGS. 4C and 4D illustrate another process of providing chemical additives to the pier cavity according to a preferred embodiment of the present invention. Referring to FIG. 4C, before the aggregate is inserted in to the pier cavity 101, the pier cavity 101 is lined with the appropriate chemical additive and then a lift 402 is formed by conventional techniques. Prior to the introduction of the aggregate for the second to lowest lift, suitable chemical additives are again added to line the cavity prior to the introduction of aggregate for the construction of the next lift. This procedure proceeds until the GEOPIER is formed of a suitable height thereby resulting in the configuration shown in FIG. 4D in which chemical additives are provided as a perimeter layer which surrounds the formation of each lift.

FIGS. 5A and 5B illustrate a process of providing gradations of aggregate according to a preferred embodiment of the present invention. Referring to FIG. 5A, there is illustrated a short aggregate pier configuration which is specifically advantageous in stiff or dense soils. A base lift 502 is formed from clean or washed stone, such as #57 stone. This bottom bulb is constructed with impact energy compaction. The advantage in using washed or clean stone is that stress transfer to the underlying matrix soils is more efficient because of grain-to-grain contact and the resultant bottom bulb is thereby more stable. Another advantage is that washed or clean stone is stable below water. The next preceding lift 504 is provided with graded base course stone and is a compacted lift which is formed using similar forces to those used in bulb 502. The advantage of using graded base course stone is that void ratios are lower, densities are higher, and stiffness is greater than with washed or clean stone. Situated on top of the compacted lift 504 is a loose lift 506 which is compacted using similar forces as those used for compacted lift 504. In this manner, gradations of aggregate may be employed to arrive at desirable characteristics for support of the pier in stiff or dense soils. Referring to FIG. 5*b*, there is illustrated a pier configuration which is advantageous in soft or loose soils. In this embodiment, a larger grade stone such as 3-inch±stone is provided in the pier bulb 508. Situated atop the larger stone bulb is a compacted lift using aggregates such as #57 stone which is compacted using appropriate forces and conventional techniques. Situated atop compacted lift 510 is a loose lift 512 which is comprised of a graded base course stone. This configuration is advantageous in soft or loose soils because the energy from the compacting force will be partially dampened and the resulting bottom bulb volume will be reduced.

FIG. 6A and 6B illustrate a process and apparatus for reducing friction in a short aggregate pier configuration according to a preferred embodiment of the invention. The dotted line 604 depicted in the soil matrix 602 designates non-active zones in the soil and active zones, with the non-active zone 606 being situated below the active zone 608. According to the present invention, a chemical lubricant 610 is provided on the outer periphery of the pier cavity. The advantage of the lubricant layer 610 is to reduce the shear force which will act on the upper portion of the pier 600 when soils in the active zone expand. Such upward shear forces have the disadvantage of causing instability due to expansion and contraction forces by moving the pier upwards during soil expansion. FIG. 6B illustrates another preferred embodiment of the present invention in which the lubricant layer 610 is provided as plastic or cardboard liner which may be provided with a chemical coating for reducing friction. The embodiment described in FIG. 6A is formed by providing the chemical lubricant layer along the walls of the pier cavity prior to the formation of the pier lifts therein. With reference to FIG. 6B, the plastic or cardboard liner is inserted prior to the compaction of the pier lifts which it encompasses.

FIG. 7 illustrates a method for liquefaction control according to a preferred embodiment of the invention. Here reference line 702 is a demarcation between nonliquefiable soil 704 and liquefiable soil 706. Line 708 is a demarcation between liquefiable soil zone 706 and nonliquefiable soil 710. According to a preferred embodiment of the present invention, the pier bulb 712 is provided in normal fashion. However, the lifts 714 provided in the liquefiable soil zone 706 are constructed with aggregate designed to meet the aggregate drain gradation specifications as specified, for example, in technical articles written by Dr. H. Bolton Seed. Seed, H. B. and Booker, J. R. EERC 76-10, University of California, Berkley, April 1976. Those lifts that are above the demarcation line 708 in non-liquefiable soil 710 may be constructed in normal fashion.

FIGS. 8A and 8B illustrate a process and apparatus for employing mesh inserts for stiffening short aggregate piers and matrix soils according to a preferred embodiment of the present invention. FIG. 8A illustrates a series of horizontally applied discs 802 of GEOGRID or mesh construction. The disc material may comprise such materials as GEOGRIDS (TENSAR GEOGRID or MIRAFI GEOGRID), geofabric such as MIRAFI or AMOCO or wire mesh. The advantage provided by the horizontally applied disks is that these tension reinforcing elements will allow higher densification to occur, resulting in a stiffer short aggregate pier. Referring to FIG. 8B, in another preferred embodiment of the invention, a GEOGRID or mesh 805 is provided vertically around the periphery of the pier. Construction of a pier according to this embodiment would include the providing of the mesh or geogrid by lining the short aggregate pier cavity prior to the construction of the lift elements 804. The advantage of providing vertical reinforcement by GEOGRID, GEOFABRIC, or wire mesh is to limit lateral bulging in very weak soils such as peat.

Figure 9A:
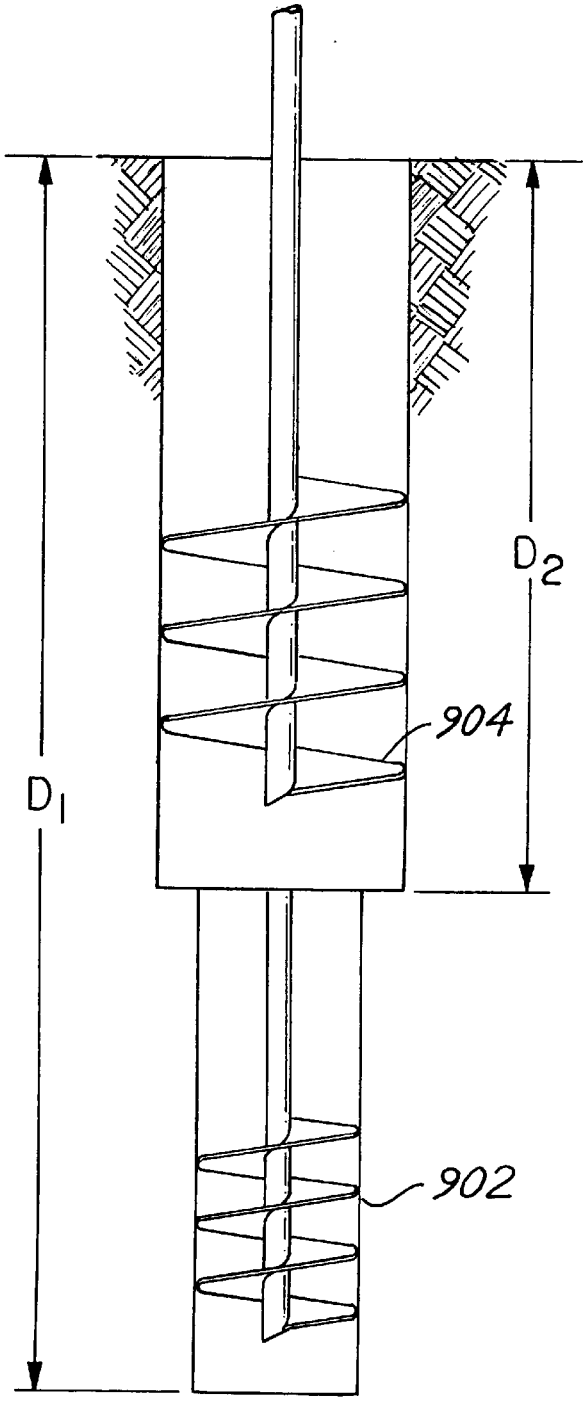
FIGS. 9A–9B illustrate a process for providing variable diameter lifts in short aggregate pier constructions and an apparatus employing variable diameter lifts according to preferred embodiments of the present invention.
Figure 9B:
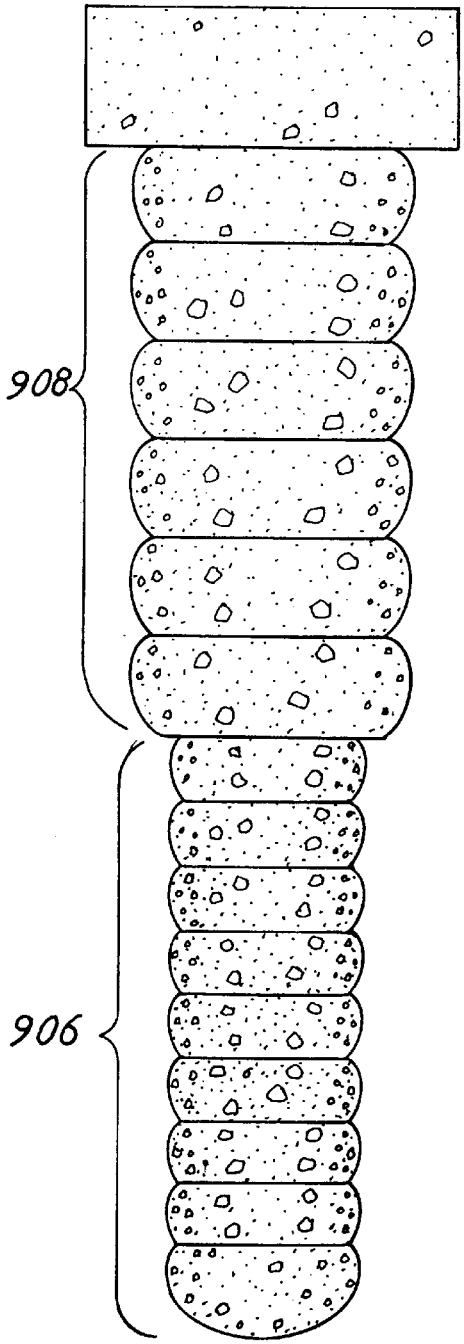

FIGS. 9A and 9B illustrate a process and apparatus for providing variable diameter lifts in short aggregate pier constructions. FIG. 9A illustrates an apparatus for drilling out variable diameter short aggregate pier cavities. The apparatus includes a first smaller diameter auger bit 902 which is used to drill to a first depth $D_1$. The apparatus also includes a second auger 904 which is of a larger diameter than auger 902 and which is used to drill a portion of the GEOPIER cavity to a depth $D_2$. The diameter of auger 904 is larger than that of auger 902. Referring now to FIG. 9B, variable diameter GEOPIERs constructed by first constructing lifts within the smaller diameter portion the lifts being referenced by the number 906. Then the larger diameter lifts 908 are constructed within the larger diameter portion of the GEOPIER cavity. For GEOPIERs made by backhoe excavation in lieu of drilling, smaller rectangular areas are constructed in lower portions of the pier, and larger rectangular areas are constructed within higher portions.

Figure 10A:
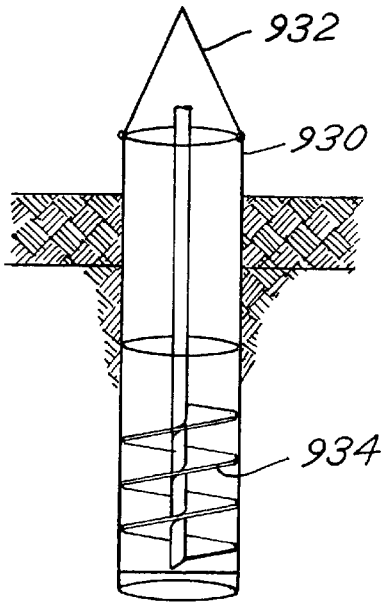
FIGS. 10A–10D illustrate a process of constructing an short aggregate pier using temporary casings according to a preferred embodiment of the present invention.
Figure 10B:
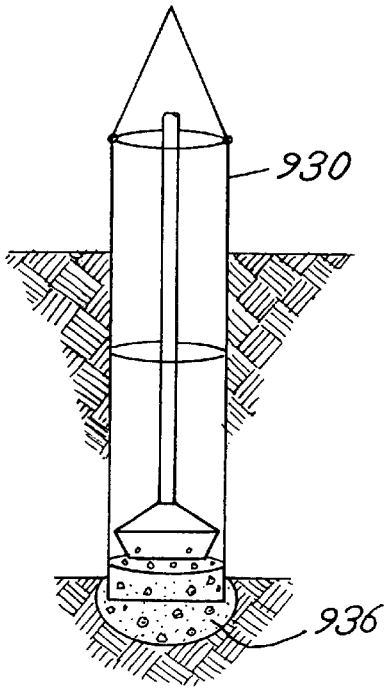

FIGS. 10A through 10D illustrate process of constructing short aggregate piers using temporary casings according to a preferred embodiment of the present invention. These casings are especially advantageous when drilling GEOPIER cavities in the vicinity of caving soils which tend to be very weak and which may not remain stable during the drilling of the GEOPIER cavity. Referring to FIG. 10A, a casing 930 is suspended by hoisting cables 932 which may be supported by a crane or other apparatus. Situated within the casing 930 is auger bit 934 which is of a diameter suitable to enable it to drill out the ground from within the interior of casing 930. As drilling of the ground with the auger 934 proceeds, the casing 930 is lowered further and further into the formed cavity. Referring now to FIG. 10B, casing 930 remains in place during the tamping stage of the lift 936. It is advisable that the bottom of the casing 930 be displaced vertically somewhat from the extreme end of the lift or bulb 936 to permit the bulging out of the bulb during the tamping stage. After the bulb is formed, the casing is raised slightly and then the aggregate introduced into the cavity to form the next lift. The casing 930 is extracted to a suitable depth to permit the bulging out of each lift element during the tamping stage.

Figure 10C:
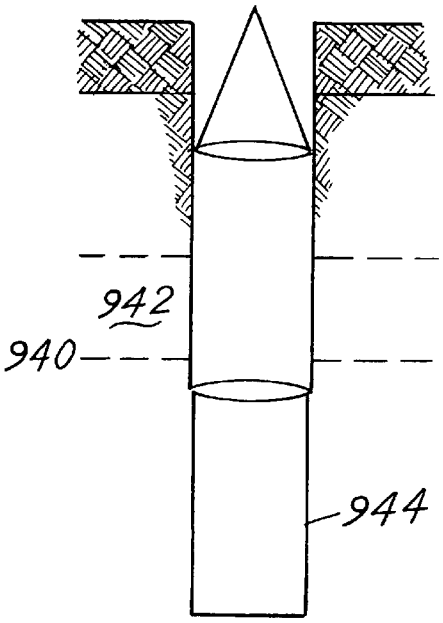
Figure 10D:
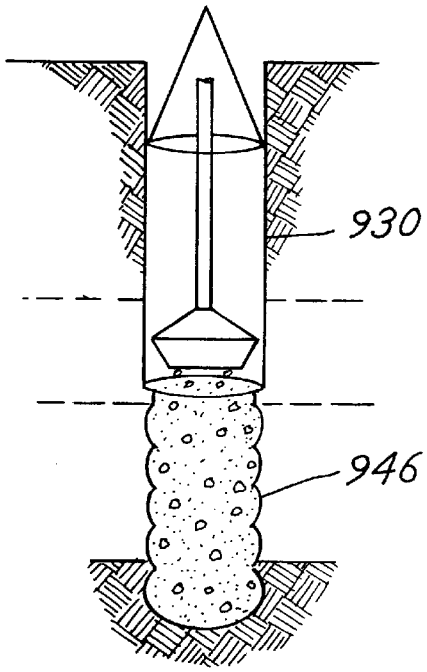

FIGS. 10C and 10D illustrate an apparatus and method for employing a casing in environments which are comprised of caving soils that may be confined by layers of stable soils. Line 940 represents a lower demarcation between a nocaving zone and caving zone 942. In accordance with the invention, the lower extreme portion of the cavity 944 is drilled with the smaller diameter which is slightly narrower than the diameter in the caving zone 942 to permit the casing to seat properly to prevent the migration of caving soils into the no-caving zone. Referring to FIG. 10D, the lower portion 946 of the pier is constructed in normal fashion in which the casing 930 remains in place. When the height of the pier 946 reaches the bottom end of the casing 930, successive formations of lift elements are accompanied by extraction of the casing 930 to a degree that will permit outward bulging of the lift elements into the caving zone. Once the GEOPIER has been constructed past the caving zone 942, the casing may be extracted or may be kept in place to maintain stability of the upper no-caving zone.

Figure 11A:
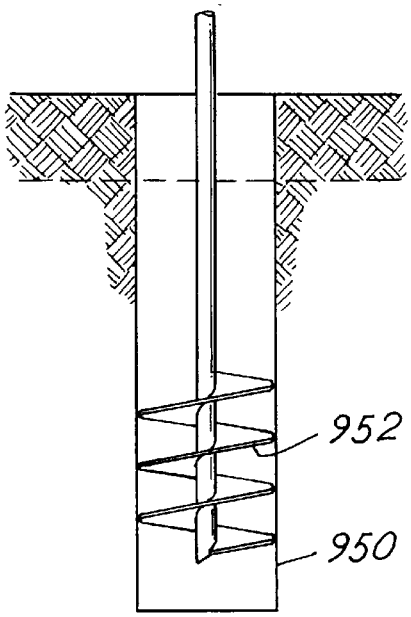
FIGS. 11A–11D illustrate a process of non-impact densification of short aggregate piers according to preferred embodiment of the present invention.
Figure 11B:
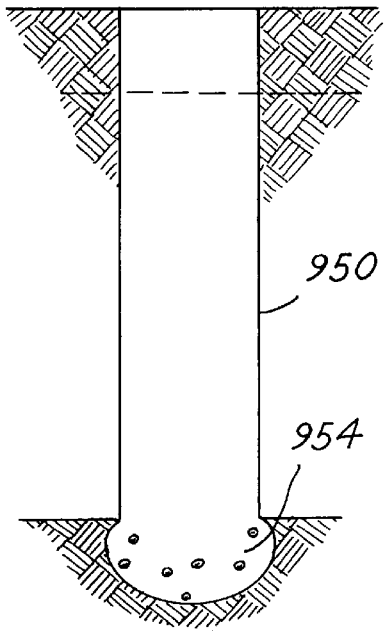
Figure 11C:
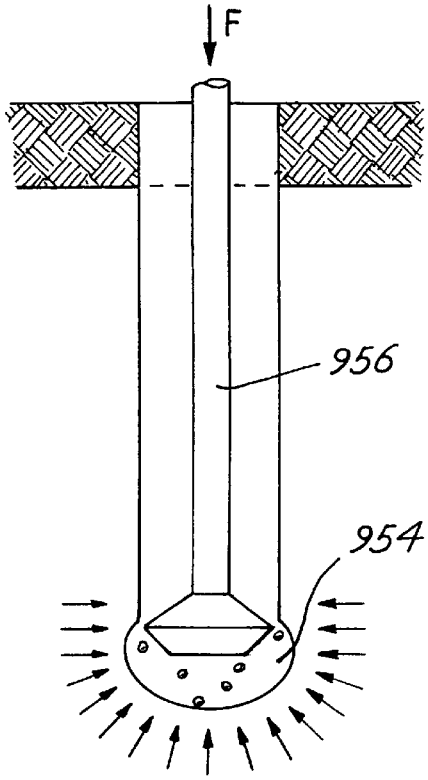
Figure 11D:
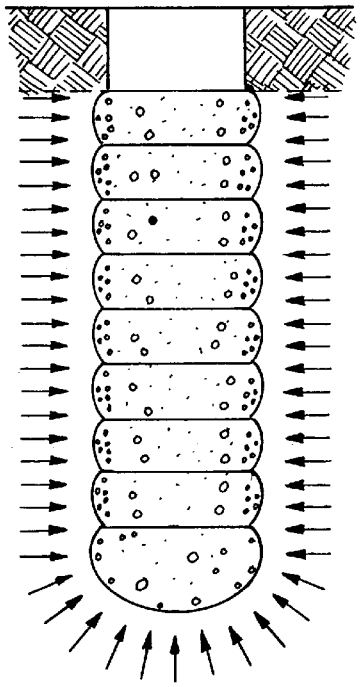

FIGS. 11A through 11D illustrate a process of nonimpact densification of short aggregate piers according to a preferred embodiment of the invention. Referring to FIG. 11A, the process begins with the formation of a cavity 950 using a suitable auger bit 952. Next, as illustrated in FIG. 11B, washed or clean stone or other suitable aggregate is placed at the bottom of the cavity 950. Referring to FIG. 11C, densification of the lift element 954 proceeds by the application of a non-impact force F on tamping element 946. According to the invention, the tamping force F is provided by a non-impact means such as, jacking against a large piece of machinery or construction equipment, or leaning against the tamper by the excavator attached to the tamper. That is, nonimpact energy is employed, or a static force which may be provided over a limited period of time. In an alternative embodiment, an optional limited vibration may be applied in conjunction with or to replace force F. The resulting pier in FIG. 11D is formed with the use of nonimpact energy.

Figure 12A:
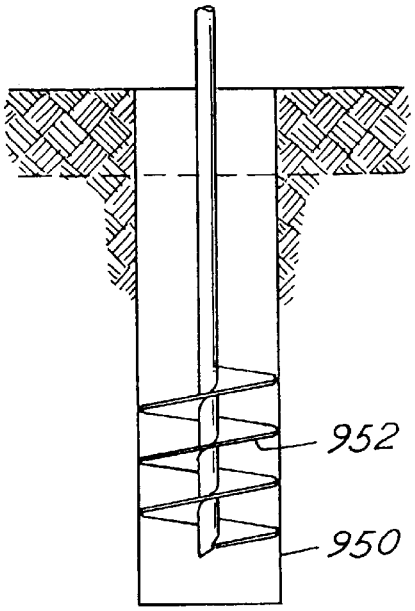
FIGS. 12A–12D illustrate a process of employing re-cycled concrete aggregate in short aggregate pier implementations according to preferred embodiment of the present invention.
Figure 12B:
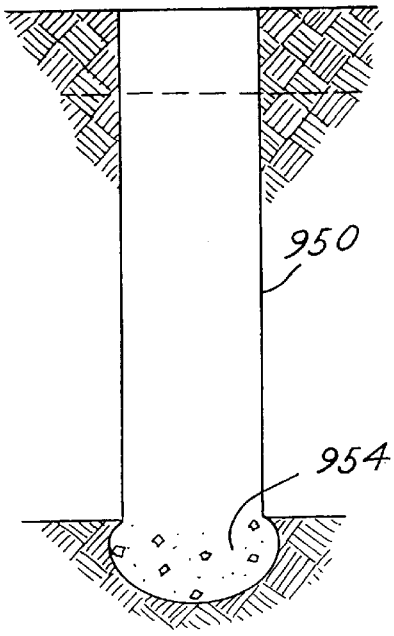
Figure 12C:
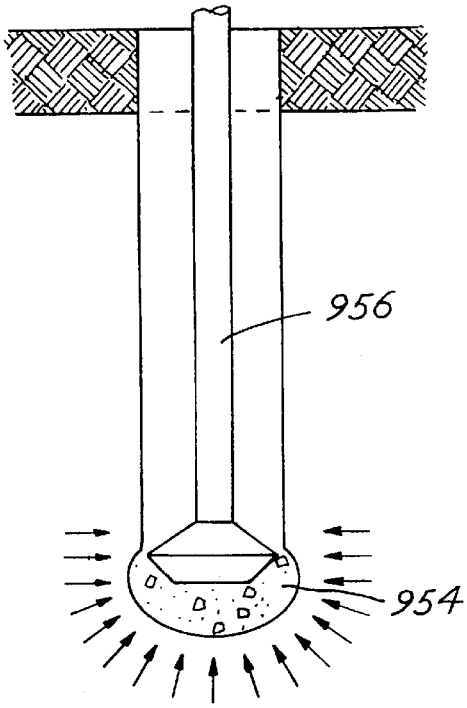
Figure 12D:
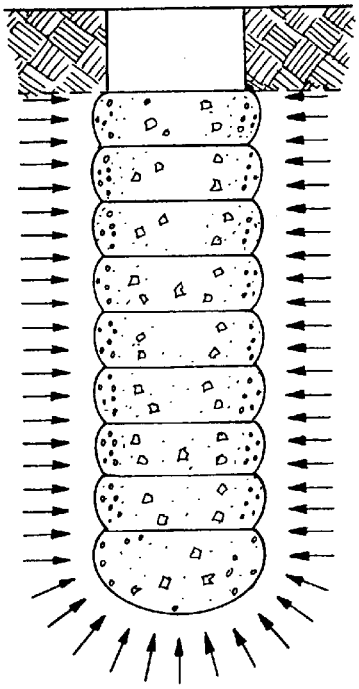
Figure 13A:
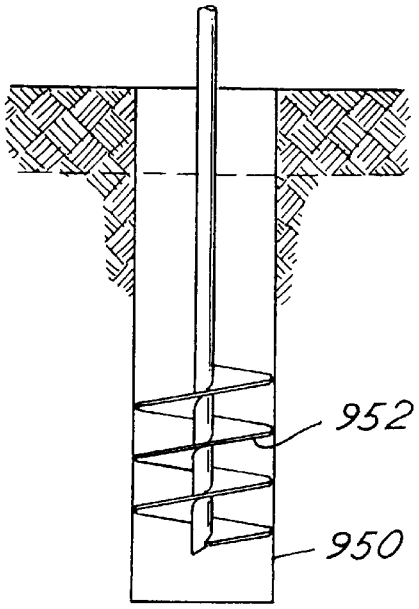
FIGS. 13A–13D illustrate a process of using sand, "roller concrete" or other materials in the lifts of short aggregate pier implementations according to another preferred embodiment of the present invention.
Figure 13B:
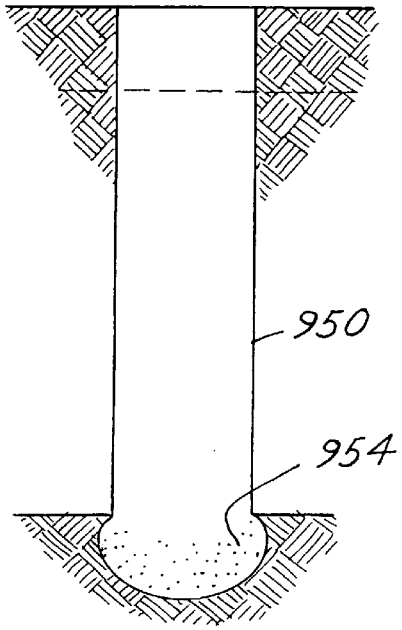
Figure 13C:
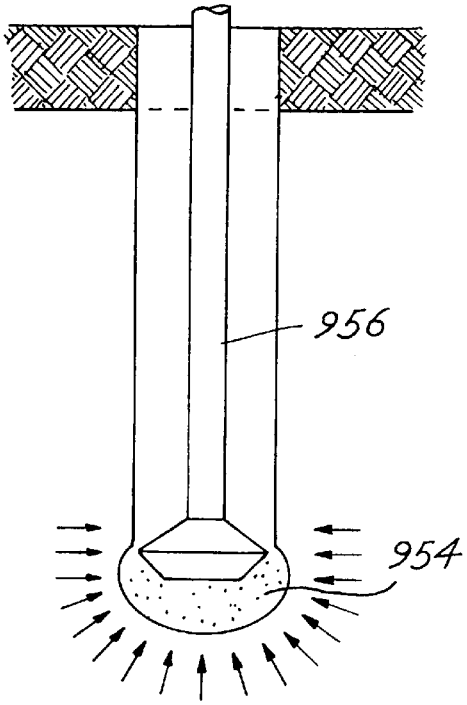
Figure 13D:
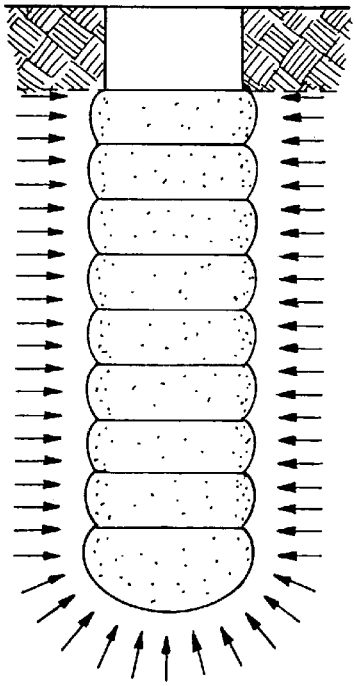

FIGS. 12A through 12D illustrate a process of employing recycled concrete aggregate in short aggregate pier implementations. Referring to FIGS. 12A through 12D, formation of the short aggregate pier proceeds by the introduction of an auger bit into the ground to form the cavity, and the introduction of washed or clean stone at the bottom of the cavity and the subsequent tamping as illustrated in FIG. 12C to form a bottom bulb. In accordance with the present invention, the washed stone may be mixed in with recycled concrete or recycled concrete may be used alone in lieu of washed stone to form a bottom bulb which is appropriately sized. Subsequent lifts of the short aggregate pier may be made with recycled concrete in lieu of graded aggregate. One advantage of the present invention in utilizing the recycled concrete is the use of jagged pieces which tend to form more stable interlocking interfaces with one another when densified.

Referring to FIGS. 13A through 13D, a process according to the present invention in another aspect may incorporate the use of sand or other materials to be provided in place of the washed stone or graded base course stone to construct the pier lifts. Types of materials which may be used include sands, soils indigenous to the area including sands, silts, and clays, chemically treated sands, silts, and clays. Another material which may be used is "roller concrete" also called "noslump concrete."

Figure 14:
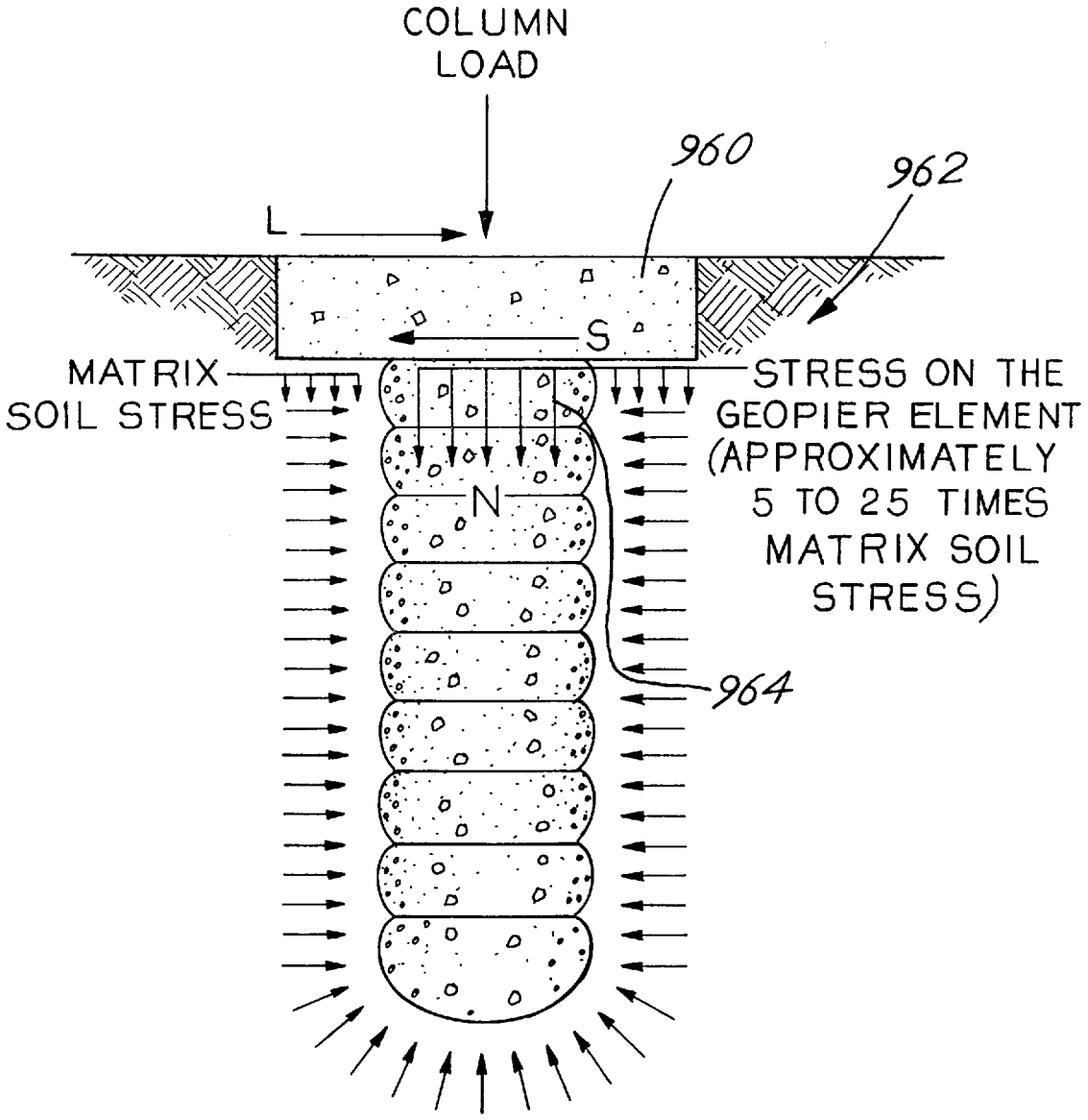
FIG. 14 illustrates a process and apparatus for providing lateral load resistance using short aggregate piers according to a preferred embodiment of the present invention.

FIG. 14 illustrates a process and apparatus for providing lateral load resistance using short aggregate piers according to a preferred embodiment of the present invention. In this embodiment, the concrete footing 960 may be subject to a lateral load L, the footer 960 being incorporated into the matrix soil 962. In accordance with the pier construction, a high vertical stress as represented by arrows 964 and designated by "N," exists at the top of the pier element and represents a vertical stress concentration that produces a high normal stress which contributes to high lateral force resistance. The high normal stress will be on the underside of the concrete footing. A shear force S which opposes the lateral force L will be provided by the follow basic equation: S=N tangent $\phi$. $\phi$ is the friction angle provided between the top of the short aggregate pier and the bottom of the footing. Normally $\phi$ is assumed to be equal to the internal friction angle of the short aggregate pier, which is 48 to 52 degrees for compacted stone aggregate. In this fashion, pier elements may be utilized to provide significant lateral load resistance in conjunction with the large vertical stress concentrations produced by the short aggregate piers.

FIG. 15 illustrates a process and apparatus for providing landslide control using short aggregate piers according to a preferred embodiment of the present invention. A land mass 970 which may be a hillside or other earthen structure, has a slope 972 and a surcharge load 974 on an upper surface thereof. Circular arc or other potential shear surfaces 976 develop within the soil mass as a result of the weight of the soil mass, the geometry of the soil mass, gravity loads and any surcharge loads. Resistance to these shear forces is provided by the inherent shear resistance of the intercepted soils. Short aggregate pier elements increase the shear resistance provided by the existing soils in three ways—(1) by providing elements with very high internal shear resistance, (2) by causing stress concentrations to occur within the short aggregate pier elements as a result of their stiffness in comparison with the matrix soil stiffness, and (3) by adding additional dead weight to the resisting portions of the short aggregate pier-reinforced soil mass, since densities of short aggregate piers are greater than densities of matrix soils.

FIG. 16 illustrates a process and apparatus for providing uplift control using short aggregate piers according to a preferred embodiment of the present invention. In accordance with the preferred embodiments of the invention, the GEOPIER element 990 is constructed with a series of uplift links 992 which are constructed of steel rods, bars, or tubes. These steel rods, bars, or tubes are connected to a bottom plate, 988. Uplift load on the footing is transferred by the uplift links to the bottom plate. The uplift force on the bottom plate is resisted by the perimeter shear resistance 996 provided by the undulating short aggregate pier-matrix soil interface and enhanced by the lateral soil stresses 994 which are increased during installation of the short aggregate pier. In this way, the pier may be configured to resist uplift loading and thereby anchor a footer or other structural element to the surrounding soil.

FIG. 17 illustrates a process and apparatus for employing load cells, stress sensors, or pressure cells in short aggregate piers according to the preferred embodiment of the present invention. As can be seen in FIG. 17, a series of load cells, stress sensors, or pressure cell elements 999 are situated between the lift elements of the pier. These load sensing elements may be attached electronically to a conventional sensing device in order to determine the magnitude of the stresses present in the load cells between the lifts of the pier element during loading of the short aggregate pier and after the total load has been applied to the pier and thereby determine the stress concentration and distribution within the pier. In addition, pressure may be applied to pressure cells situated between lift elements of the pier and deformations resulting from the applied stress may be measured.

FIGS. 18A and 18B illustrate techniques for testing characteristics, such as stiffness, of short aggregate piers, in accordance with the invnention. Referring to FIG. 18A, a load transmitting element 180, such as a tamper assembly, is provided with a calibrated pressure or load measuring device 184 on the load transmitting element to determine magnitude of applied load. A deflection measuring device 182 is also provided on load transmitting element 180. It will be understood by those of ordinary skill that load measuring device 184 may comprise a strain gauge or other implement for determining the load on the shaft of the tamper assembly or load transmitting element 180. Deflection measuring device 182 measures the displacement of the load transmitting element 180, and thus the displacement of the short aggregate pier 190, relative to the surrounding earth. It will be understood by those of ordinary skill that deflection measuring device 182 may comprise a laser measuring device to measure relative deflection. Alternatively, deflection measuring device 182 may comprise a first manometer element affixed to the load transmitting element 180 and a second manometer element, fixed on the ground and sufficiently remote from the pier 190 to prevent ground deflection caused by the load transmitting element 180. The manometer devices will measure relative deflection. Deflection measurement may also include level survey apparatus, or other means. Referring to FIG. 18B, there is illustrated an alternative embodiment of the present invention in which the load measuring device is provided as a load or pressure cell 186 disposed between the tamper assembly 180 and the short aggregate pier 190.

The pier stiffness may be calculated from the measured load and deflection. A verification modulus is calculated from the load and deflection measurements according to the following formula:

$$K_v = P/A\ y \quad (1)$$

where $K_v$ represents the verification modulus; P represents the applied load; A represents the top area of the short aggregate pier; and y represents the downward vertical deflection of pier. The verification modulus thus determined is used as an indicator of the pier stiffness modulus corresponding to the pier project design stress by means of extrapolation and comparison with measured pier stiffness modulus value under the same stress intensity as that generated in the pier modulus load test.

Those skilled in the art will recognize that the preferred embodiments may be altered or amended without departing from the true spirit and scope of the invention, as defined in the accompanying claims.

What is claimed is:

1. A method of constructing a short aggregate pier in a soil matrix comprising, in combination, the steps of:

a) forming a cavity in the soil matrix by withdrawing material from the soil matrix to form the cavity;

b) at least partially filling the cavity with successive lifts of aggregate, at least some of said lifts being compacted in serial order as the said lift is filled into the cavity to thereby form a short aggregate pier in the cavity comprised of multiple lifts at least some of which are compacted subsequent to their placement in the cavity and prior to placement of further lifts thereon; and c) loading the totality of lifts comprising the aggregate pier subsequent to the placement and compaction of the separate lifts and subsequent to formation of the total pier, and prior to placement of a structure on the pier by placing a post pier construction load comprising a loaded plate on the uppermost lift to effect at least partially irreversible compression of the pier and at least partially irreversible strain of the soil matrix adjacent the pier.

2. The method of claim 1 wherein the loading of the formed aggregate pier comprises static loading.

3. The method of claim 1 wherein the loading of the formed aggregate pier comprises dynamic loading.

4. The method of claim 1 wherein the step of filling the cavity with successive lifts comprises forming at least some of the lifts with aggregate having a specified drain gradation specification.

5. The method of claim 1 wherein the step of filling the cavity with successive lifts comprises forming at least some of the lifts from a material selected from a group consisting of a mixture of stone and recycled concrete, recycled concrete, aggregate having a drain gradation specification, mixed sand and stone, differently graded stone in a mixture, and combinations thereof.

6. The method of claim 1 including an additional step selected from the group consisting of coating at least one said lift between the pier and the cavity walls with a lubricant material, incorporating a mesh in at least one said lift, varying the diameter of at least two said adjacent lifts and implanting at least one load cell in said pier.

7. The method of claim 1 including the step of measuring the post pier construction load and pier deformation when loading the formed aggregate pier and prior to placement of a structure on said pier.

8. A method of constructing a short aggregate pier in a soil matrix comprising, in combination, the steps of:

a) forming a cavity in the soil matrix by withdrawing material from the said matrix;

b) at least partially filling the cavity with successive lifts of aggregate, at least some of the lifts being compacted when filled into the cavity, said lifts being formed from material selected from the group consisting of stone, a mixture of stone and recycled concrete, sand, a mixture of sand and stone, recycled concrete, aggregate having an aggregate drain gradation specification, differently graded stone aggregate and mesh materials, aggregate and chemical additives, and combinations thereof including at least one of said materials; and c) loading the uppermost lift of the formed aggregate pier subsequent to placement and compaction of the separate lifts and subsequent to formation of the total pier and prior to placement of a structure on the pier by placing a post pier construction load comprising a loaded plate on the uppermost lift to effect at least partially irreversible compression of the pier and at least partially irreversible strain of the soil matrix adjacent the pier.

9. The method of claim 1 or claim 8 wherein the step of filling the cavity comprises at least partially filling the cavity with successive lifts of material, said lifts being compacted in serial order as the lifts are filled into the cavity to thereby form a short aggregate pier, said lifts being formed from material selected from the group consisting of distinct aggregate sizes in distinct lifts, sand and stone mixture, and aggregate with mesh material.

10. The method of claim 1 or claim 8 wherein the step of filling the cavity comprises at least partially filling the cavity with successive lifts of material, said lifts being compacted in serial order as the lifts are filled into the cavity to thereby form a short aggregate pier, at least some of said lifts formed with a distinct diameter different from the diameter of other lifts in the pier.

11. The method of claim 1 or claim 8 including the step of placement of at least one load cell in the pier.

12. The method of claim 1 or claim 8 wherein the post pier construction load is associated with the proposed structure load on the pier and subsequent removal of the said post pier construction load.

13. The method of claim 1 or claim 8 including successively loading and unloading the formed pier.

* * * * *